US011686173B2

(12) United States Patent
Tran et al.

(10) Patent No.: US 11,686,173 B2
(45) Date of Patent: Jun. 27, 2023

(54) ROTARY CONTROL DEVICE WITH SELF-CONTAINED HYDRAULIC RESERVOIR

(71) Applicant: Premium Oilfield Technologies, LLC, Houston, TX (US)

(72) Inventors: Lap Tan Tran, Cypress, TX (US); Douglas Jahnke, Hockley, TX (US)

(73) Assignee: PREMIUM OILFIELD TECHNOLOGIES, LLC, Houston, TX (US)

( * ) Notice: Subject to any disclaimer, the term of this patent is extended or adjusted under 35 U.S.C. 154(b) by 71 days.

(21) Appl. No.: 17/245,359

(22) Filed: Apr. 30, 2021

(65) Prior Publication Data

US 2021/0340834 A1 Nov. 4, 2021

Related U.S. Application Data

(60) Provisional application No. 63/018,025, filed on Apr. 30, 2020.

(51) Int. Cl.
*E21B 33/08* (2006.01)

(52) U.S. Cl.
CPC ..... *E21B 33/085* (2013.01)

(58) Field of Classification Search
CPC ..... E21B 33/085; E21B 33/038; E21B 33/06
See application file for complete search history.

(56) References Cited

U.S. PATENT DOCUMENTS 2,170,916 A * 8/1939 Schweitzer ..... E21B 33/085 175/84
2,995,196 A * 8/1961 Gibson ..... E21B 7/128 175/7
3,176,996 A * 4/1965 Barnett ..... F16J 15/008 277/516

(Continued)

FOREIGN PATENT DOCUMENTS

CN 101796258 A * 8/2010 ..... E21B 33/085
EP 2295712 A2 3/2011

(Continued)

OTHER PUBLICATIONS

Merriam-Webster, "Rservoir", downloaded Dec. 19, 2022, 9 pages (Year: 2022).*

*Primary Examiner* — Jennifer H Gay
(74) *Attorney, Agent, or Firm* — Jackson Walker, LLP

(57) ABSTRACT

An improved rotating control device, having a spool and removable bearing assembly, provides a self-contained hydraulic reservoir that can be operated with standard air pressures from an air hose or other readily available source, eliminating traditional surface hydraulic power units (HPUs). Hydraulically operated pistons can be spring biased to close latching elements around the bearing assembly. Hydraulic fluid can be forced from the self-contained hydraulic reservoir through flow paths to hydraulic cylinders to force the pistons to retract radially outward to release the bearing assembly for removal. The bearing assembly can include a lubricant reservoir to supply gravity-fed or pressurized lubrication for internal roller bearings. The bearing assembly can further include a rotary seal in several embodiments that efficiently reduces risks of dropping bolts on personnel and in the wellbore.

20 Claims, 19 Drawing Sheets

(56) References Cited

U.S. PATENT DOCUMENTS 3,333,870 A * 8/1967 Watkins ..... E21B 33/038 248/909
4,222,592 A * 9/1980 Saliger ..... E21B 33/038 285/308
5,348,107 A * 9/1994 Bailey ..... E21B 33/085 175/162
5,647,444 A 7/1997 Williams
5,662,181 A 9/1997 Williams et al.
5,901,964 A 5/1999 Williams et al.
7,174,956 B2 2/2007 Williams et al.
7,237,618 B2 7/2007 Williams
7,240,727 B2 7/2007 Williams
7,559,359 B2 * 7/2009 Williams ..... E21B 33/085 166/84.3
7,708,089 B2 * 5/2010 Williams ..... E21B 47/12 166/84.5
7,717,170 B2 * 5/2010 Williams ..... E21B 33/085 166/85.4
7,918,291 B2 * 4/2011 Williams ..... E21B 33/085 166/84.3
8,066,062 B2 11/2011 Edvardsen et al.
8,100,189 B2 1/2012 Edvardson et al.
8,360,159 B2 * 1/2013 Williams ..... E21B 33/085 166/85.5
9,010,433 B2 * 4/2015 Rios, III ..... E21B 33/038 166/344
9,260,934 B2 2/2016 Godfrey et al.
10,145,199 B2 12/2018 Linde et al.
10,330,157 B2 6/2019 Arnt et al.
10,724,325 B2 * 7/2020 Yousef ..... E21B 33/085
10,858,904 B2 * 12/2020 Yousef ..... E21B 23/02
10,941,629 B2 * 3/2021 Yousef ..... E21B 4/003
11,391,112 B2 * 7/2022 Dietrich ..... E21B 33/085
2008/0296016 A1 * 12/2008 Hughes ..... E21B 33/085 166/250.01
2009/0057023 A1 * 3/2009 Williams ..... E21B 33/085 175/195
2009/0057024 A1 * 3/2009 Williams ..... E21B 33/085 175/209
2009/0101333 A1 * 4/2009 Williams ..... E21B 33/085 166/84.1
2009/0139724 A1 6/2009 Gray et al.
2009/0200747 A1 * 8/2009 Williams ..... E21B 47/12 277/344
2009/0260887 A1 * 10/2009 Williams ..... E21B 33/085 175/195
2010/0089655 A1 * 4/2010 Williams ..... E21B 33/085 29/428
2011/0024195 A1 2/2011 Hoyer et al.
2011/0315404 A1 12/2011 Bailey et al.
2012/0013133 A1 * 1/2012 Rios, III ..... E21B 33/038 292/159
2014/0027129 A1 1/2014 Hannegan et al.
2016/0258239 A1 * 9/2016 Clark ..... E21B 33/085
2019/0093445 A1 * 3/2019 Kulkarni ..... E21B 33/085
2019/0234173 A1 * 8/2019 Bennett ..... E21B 47/06
2020/0040688 A1 * 2/2020 Yousef ..... E21B 23/00
2020/0040689 A1 * 2/2020 Yousef ..... E21B 23/02
2020/0040690 A1 * 2/2020 Yousef ..... E21B 4/003
2021/0189828 A1 * 6/2021 Dietrich ..... E21B 17/085
2021/0340834 A1 * 11/2021 Tran ..... E21B 41/0021

FOREIGN PATENT DOCUMENTS

WO WO-2019213145 A1 * 11/2019 ..... E21B 33/068
WO WO-2019213162 A1 * 11/2019 ..... E21B 21/08

* cited by examiner

ROTARY CONTROL DEVICE WITH SELF-CONTAINED HYDRAULIC RESERVOIR

CROSS REFERENCE TO RELATED APPLICATIONS

This application claims the benefit of U.S. Provisional Application No. 63/018,025, filed Apr. 30, 2020, entitled "Rotary Control Device with Hydraulic Chamber", which is incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to drilling equipment typically used on a drilling rig. More specifically, the disclosure relates to drilling equipment used to transition between a fixed connection and a rotating connection and coupling of components thereof, where the drilling equipment can be used for the extraction of hydrocarbons from below the earth's surface.

Description of the Related Art

Drilling operations, particularly in the oilfield, can be used to extract fluids from the earth. Pressure control equipment can be placed on a well during operations near the surface of the earth. The pressure control equipment cab control the pressure in the wellbore while drilling, completing, and producing the well. The pressure control equipment can include blowout preventers, rotating control devices, and the like. A rotating control device ("RCD") is a drill-through device with a rotating seal that contacts and seals against a drill string of drill pipe, tool joints, casing, and so forth to control a pressure or fluid flow to the surface.

Typical RCDs have two major components—a outer component with a bore known as a "spool" and a central removable component known as a "bearing", herein a "bearing assembly" for clarity. The bearing assembly is removably mounted inside the spool bore. The bearing assembly has an inner guide that engages with and rotates with the drill pipe, an outer shell that is stationary and coupled with the stationary spool bore, and bearings (generally roller bearings) between the inner guide and outer shell. The bearing assembly can be inserted into the spool bore and latched with a latching device that secures the bearing assembly within the spool. The spool is typically piped with conduits for drilling mud to flow down into the well and exit out a port on the spool and for providing hydraulic fluid to the spool to actuate the latching device to the bearing assembly. Typical RCDs are fully hydraulically operated with a separate hydraulic pump unit ("HPU") on a rig floor or well site deck near ground level with piping connecting the HPU to the RCD. The HPU provides the pressurized hydraulic fluid to hydraulic cylinders that close and open a latching device around the bearing assembly, such as a clamshell, or a servomotor to rotate a screw to close and open the latching device that is removably inserted into the RCD. Other latching devices are manually operated to ensure closure around the bearing assembly. Because the bearing assembly must withstand the downhole pressure, an improperly latched bearing assembly can cause significant damage to property and perhaps personnel injury. With personnel realizing that hydraulic cylinders can fail to latch properly, a typical procedure is for personnel to climb to the top of the oil rig where the RCD is installed to manually check the proper latching, which can cause additional risks to personnel safety. Climbing to the top of the rig to manually close or release the latching device around the bearing assembly involves personnel risks for the same reason.

Further, the roller bearings need lubrication during operation. The roller bearings can leak lubrication, and so the roller bearings need the lubrication to be replenished. The roller bearings can be manually lubricated by climbing up to the RCD, or a separate lubrication module with a container, pump, and piping from the rig floor to the roller bearings can provide the lubrication.

Third, an elongated seal is removably attached to the bearing assembly. The seal surrounds the drill pipe and seals mud and well bore fluids from reaching the bearing assembly and from escaping into the environment through the RCD. A typical seal needs attachment to the bearing assembly by bolts inserted radially through the bearing assembly into the seal. If a bolt drops during installation and falls into the rig floor or into the wellbore, the bolt can cause personnel injury or issues in subsequent drilling.

Rotating control devices are described in EP 2295712, US Pat. Publ. No. 2014/0027129, US Pat. Publ. No. 2009/0139724, US Pat. Publ. No. 2011/0024195, US Pat. Publ. No. 2011/0315404, U.S. Pat. Nos. 10,330,157, 10,145,199, 9,260,934, 8,100,189, 8,066,062, 7,240,727, 7,237,618, 7,174,956, 5,647,444, 5,662,181, and 5,901,964, which are incorporated herein by reference.

In summary, the reliance on a separate HPU on a rig floor with the pump, hydraulic reservoir, hydraulic lines, motor, and a cooling fan adds costs and complexity to the operation. The added lubrication module form the rig floor for the roller bearings adds further costs and complexity. The HPU and lubrication module also take space on a crowded rig floor or well site. The periodic accidental drop of a bolt during installation or removal of the seal with the bearing assembly can cause injury or issues with subsequent drilling operations if it falls in the wellbore.

Therefore, there is a need for an improved RCD.

BRIEF SUMMARY OF THE INVENTION

An improved rotating control device, having a spool and removable bearing assembly, provides a self-contained hydraulic reservoir that can be operated with standard air pressures from an air hose or other readily available source, eliminating traditional surface hydraulic power units (HPUs). Hydraulically operated pistons can be spring biased to close latching elements around the bearing assembly. Hydraulic fluid can be forced from the self-contained hydraulic reservoir through flow paths to hydraulic cylinders to force the pistons to retract radially outward to release the bearing assembly for removal. The bearing assembly can include a lubricant reservoir to supply gravity-fed or pressurized lubrication for internal roller bearings. The bearing assembly can further include a rotary seal in several embodiments that efficiently reduces risks of dropping bolts on personnel and in the wellbore.

The disclosure provides a rotating control device for use in extraction of fluids from a wellbore, comprising: a spool having a bore along a longitudinal axis and a bearing assembly removably coupled with the spool bore. The spool comprises: a reservoir for fluid having a pressure port configured to receive pressure for the reservoir; a latching assembly cylinder bore formed in the spool at an angle to the longitudinal axis; a flow path for the fluid between the reservoir and the latching assembly cylinder bore; and a latching assembly coupled in the latching assembly cylinder bore. The latching assembly comprises: a piston assembly comprising a sealing ring, a piston slidably coupled with the sealing ring, a piston rod housing coupled with the sealing ring, a piston rod slidably coupled in the piston rod housing, and a bias element coupled between the piston rod and the piston rod housing, and further a latching element coupled to the piston rod. The bearing assembly has a bearing assembly latch surface configured to engage with the latching element when the latching element is extended toward the bearing assembly by the piston rod.

The disclosure provides a rotating control device for use in extraction of fluids from a wellbore, comprising: a spool having a bore along a longitudinal axis, the spool comprising: a reservoir for fluid having a pressure port configured to receive pressure for the reservoir; a latching assembly cylinder bore formed in the spool at an angle to the longitudinal axis; a flow path for the fluid between the reservoir and the latching assembly cylinder bore; and a latching assembly coupled in the latching assembly cylinder bore. The latching assembly comprises: a piston assembly comprising a piston slidably coupled in the latching assembly cylinder bore, a piston rod slidably coupled in the piston and a bias element coupled between the piston rod and the piston; and further a latching element coupled to the piston rod.

The disclosure further provides a method of configuring a rotating control device in extraction of fluids from a wellbore, the rotating control device having a spool having a bore along a longitudinal axis, the spool having a reservoir for fluid with a pressure port, a latching assembly cylinder bore formed in the spool at an angle to the longitudinal axis, a flow path for the fluid between the reservoir and the latching assembly cylinder bore, a latching assembly coupled in the latching assembly cylinder bore, the latching assembly having a piston assembly with a piston slidably coupled in the latching assembly cylinder bore, a piston rod slidably coupled in the piston, and a bias element coupled between the piston rod, and the piston and the latching assembly further having a latching element coupled to the piston rod, and a bearing assembly removably coupled to the spool in the spool bore, the method comprising: pressurizing the reservoir on the spool through the pressure port; allowing pressurized fluid from the reservoir to flow along the flow path to the latching assembly cylinder bore; retracting the piston in a radially outward direction from a center of the spool; inserting the bearing assembly in the spool bore; depressurizing the fluid in the latching assembly cylinder bore; allowing the piston to extend radially inward; and allowing the latching element to engage the bearing assembly.

The improved rotating control device provides a self-contained hydraulic reservoir that can be built into the ROD, specifically the spool of the ROD. The self-contained hydraulic reservoir has sufficient volume of hydraulic fluid to actuate pistons in hydraulic cylinders circumferentially located around the spool. The pistons are biased with a force, such as with springs, to push latching elements radially inward toward a bearing assembly inserted into the bore of the spool that latch the bearing assembly with the spool. To release the bearing assembly, the hydraulic cylinders are pressurized with hydraulic fluid to retract the piston into the hydraulic cylinder, thereby pulling the latching elements radially outward away from the bearing assembly. The fluid does not flow continuously but generally flows when pressurized fluid is applied to the pistons to retract the piston rods or the fluid flows back to the reservoir when the fluid is depressurized and the piston rods extend to push back the fluid to the reservoir. The energy source that can apply force on the hydraulic fluid can be pressurized air. The pistons and their pressure square area can be sized to allow the self-contained hydraulic reservoir to be operated with standard air pressures, such as 40 psi to 120 psi, from an air hose or other readily available supply. Such an air supply is already available on the rig. Alternatively, the low volume needed for air pressure can be supplied with a charged cylinder, such as a nitrogen cylinder, that can be mounted at or near the spool. The HPU and the costs and floor space of an HPU can be eliminated. Thus, the pistons can be spring biased to close the latching elements around the bearing assembly in a normal position that would occur without power. Pressurized air can be provided through a port into the self-contained hydraulic reservoir to pressurize the hydraulic fluid. The hydraulic fluid can flow through flow paths to the several hydraulic cylinders bores around the circumference of the spool, the cylinders having their respective piston assemblies mounted therein. In at least one embodiment, the flow path can include a circular channel around the spool connecting a plurality of the hydraulic chambers. The hydraulic fluid can flow through a flow path to each hydraulic cylinder. The hydraulic fluid can create a greater force on the pistons than a counter force of the spring bias to pull the pistons radially outward and radially retract the pistons from the bearing assembly. Thus, the pistons are operated to retract the latching elements to allow removal of the bearing assembly. When no air pressure is applied, the pistons and latching elements are free to move radially inward from the spring force to latch the bearing assembly into the spool for a "fail-safe" system. If power is lost, the latching elements default into a closed latching position due to the spring bias. This fail-safe mode reduces or eliminates the need for personnel to climb to the top of the rig and manually confirm latching from a remote hydraulically operated closure system or manually engage the bearing assembly into a latched position.

Second, the improved RCD can contain a lubricant reservoir on or in the spool for supplemental lubrication of the roller bearings. The lubricant in the self-contained lubricant reservoir can be gravity feed into bearings in the bearing assembly by mounting above the roller bearings and providing one or more flow paths from the reservoir to the bearings. Alternatively, the self-contained lubricant reservoir can be pressurized with air, including with a bladder separating the air from the lubrication if desired, to push the lubrication into the roller bearings as needed.

Third, an elongated pipe seal is generally located at the lower end of the bearing assembly. In at least one embodiment, the seal can be more securely and readily installed with the bearing assembly with a series of peripheral slots in an upper portion of the pipe seal and corresponding inner guide slots in a lower mating portion of the inner guide of the bearing assembly. In at least one embodiment, a bearing seal retainer, which includes a seal lock ring, inserts, and the slots, can longitudinally restrain the seal with the bearing assembly. The inserts can fit in the seal slots and corresponding bearing assembly slots, when the slots are mutually aligned, to secure the seal longitudinally with the bearing assembly. The outward member (in at least one embodiment, the pipe seal) can have through slots that are formed fully through the wall of the seal. The inward member (in at least one embodiment, the bearing assembly) can have blind slots that are formed only partially through the wall of the bearing assembly. The seal lock ring can be premounted around the seal longitudinally offset from the seal slots. The seal can be longitudinally slid onto the bearing assembly so that a portion of the bearing assembly is mounted inside the seal. When the seal slots and bearing assembly slots are longitudinally and circumferentially aligned, the inserts can be inserted through the seal slots and into the bearing assembly slots. The seal lock ring can be moved longitudinally along the outer surface of the pipe seal to align with the inserts. When the retainer is longitudinally aligned, it can fit into a circular groove aligned with the inserts to retain the inserts in the slots. The risk of losing components into the wellbore is greatly reduced. In at least another embodiment, the fit of the components can be reversed, so that a portion of the pipe seal fits inside the bearing assembly, and the inserts are inserted through the bearing assembly slots and into the seal slots with the seal lock ring mounted around the bearing assembly to retain the inserts therein.

DETAILED DESCRIPTION

Figure 1:
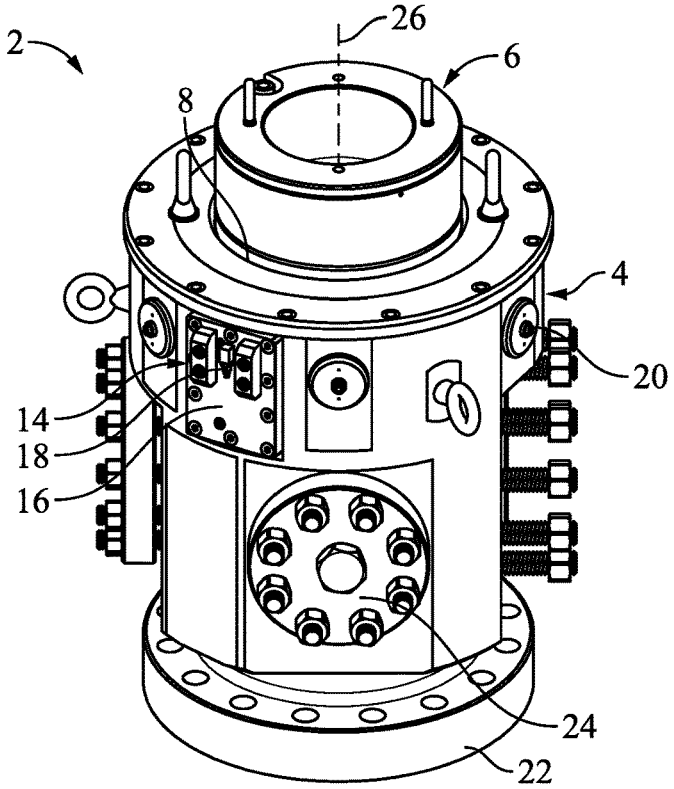
FIG. 1 is a schematic perspective view of a rotating control device ("RCD"), having a spool with a bearing assembly coupled in the spool, according to the disclosure herein.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation or location, or with time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally. The device or system may be used in a number of directions and orientations. The order of steps can occur in a variety of sequences unless otherwise specifically limited. The various steps described herein can be combined with other steps, interlineated with the stated steps, and/or split into multiple steps. Some elements are nominated by a device name for simplicity and would be understood to include a system or a section, such as a controller would encompass a processor and a system of related components that are known to those with ordinary skill in the art and may not be specifically described. Various examples are provided in the description and figures that perform various functions and are non-limiting in shape, size, description, but serve as illustrative structures that can be varied as would be known to one with ordinary skill in the art given the teachings contained herein.

An improved rotating control device, having a spool and removable bearing assembly, provides a self-contained hydraulic reservoir that can be operated with standard air pressures, such as 40 to 120 psi, from an air hose or other readily available source, eliminating traditional surface hydraulic power units (HPUs). Hydraulically operated pistons can be spring biased to close latching elements around the bearing assembly. Hydraulic fluid can be forced from the self-contained hydraulic reservoir through flow paths to hydraulic cylinders to force the pistons to retract radially outward to release the bearing assembly for removal. The bearing assembly can include a lubricant reservoir to supply gravity-fed or pressurized lubrication for internal roller bearings. The bearing assembly can further include a rotary seal in several embodiments that efficiently reduces risks of dropping bolts on personnel and in the wellbore.

Figure 2:
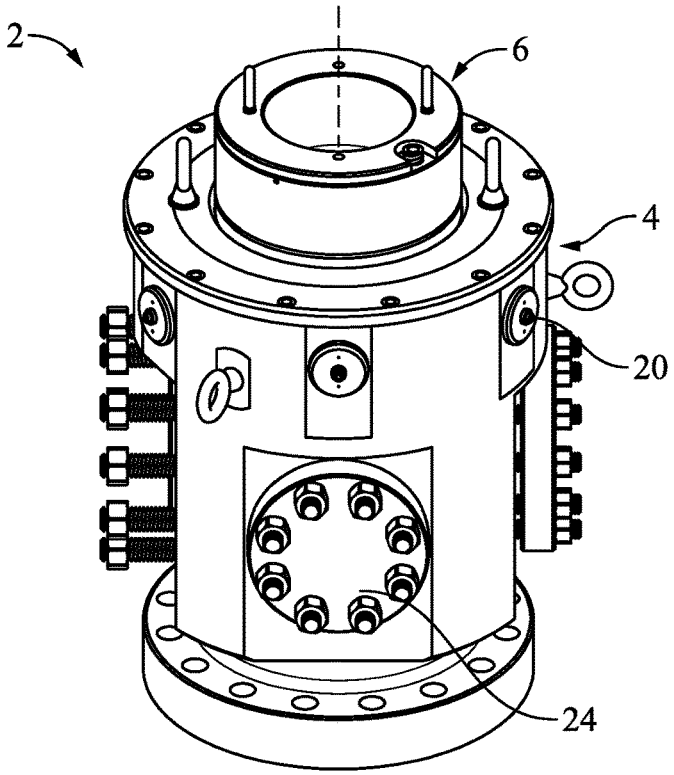
FIG. 2 is a schematic perspective view of the spool of the RCD of FIG. 1 illustrating hydraulic cylinders formed in the spool sidewall and radially spaced around the spool periphery.

FIG. 1 is a schematic perspective view of a rotating control device ("ROD"), having a spool with a bearing assembly coupled in the spool, according to the disclosure herein. FIG. 2 is a schematic perspective view of the spool of the RCD of FIG. 1 illustrating hydraulic cylinders formed in the spool sidewall and radially spaced around the spool periphery. An RCD 2 generally includes a spool 4 and a bearing assembly 6, generally aligned around a central longitudinal axis 26 (and 26' when specifically describing the bearing assembly in some figures herein). The bearing assembly 6 is insertable into an inner bore 8 of the spool and held in place by latching assemblies 20 spaced around the spool periphery. An inner guide 10 of the bearing assembly 6 rotates with pipe (being broadly defined to include tubing) that can be inserted through the inner guide. The spool 4 includes a self-contained hydraulic reservoir 14 having fluid used to actuate the latching assemblies 20. This self-contained hydraulic reservoir 14 eliminates the need for a typical hydraulic power unit (HPU) on a rig floor and the typical hydraulic lines from the rig floor to the top of the rig where the RCD is mounted. The self-contained hydraulic reservoir 14 includes a cover plate 16 for accessing the reservoir cavity and is formed with a pressure port 18. The pressure port 18 allows a standard supply of air pressure readily available around the rig from a pressure source, such as an air compressor, to be coupled to the hydraulic reservoir 14 to pressurize the hydraulic fluid in the reservoir. The latching assemblies 20 can be mounted in a latching assembly cylinder bore 30 and are spaced around a periphery of the spool. The latching assembly 20 can actuate a latching element described below to hold the bearing assembly 6 in the spool 4. An attachment means, such as a mounting flange 22, can mount the RCD to the rig.

Figure 3:
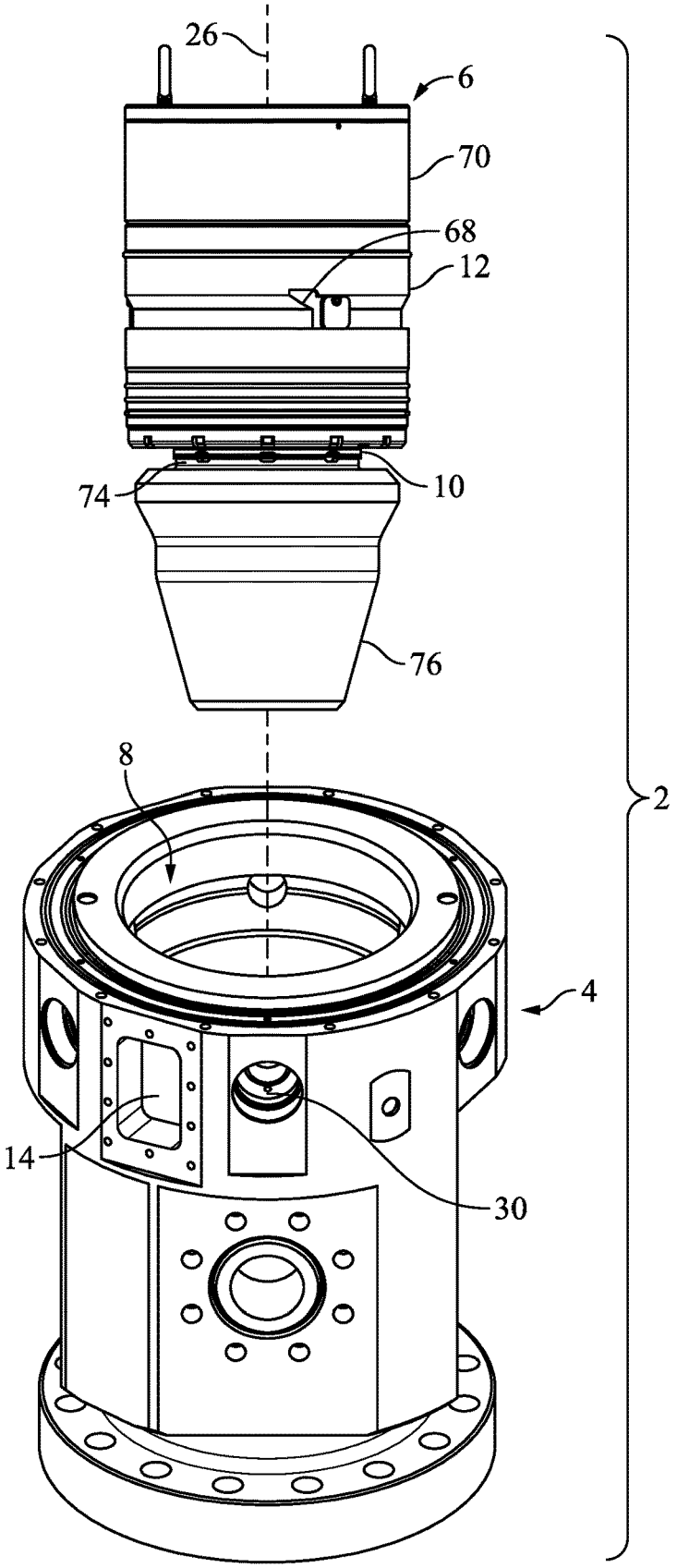
FIG. 3 is a schematic partial assembly view of the RCD with the bearing assembly separated from the spool.

FIG. 3 is a schematic partial assembly view of the RCD with the bearing assembly separated from the spool. The bearing assembly 6 can be inserted into the spool bore 8 of the spool 4. The bearing assembly 6 includes an outer shell 12 that is stationary in the spool and an inner guide 10, which with the pipe rotates inside the outer shell, such as during drilling operations. The bearing assembly 6 further includes a bearing assembly latch surface 68 for the latching assembly to engage and disallow rotation of the outer shell 12 of the bearing assembly during rotation of the pipe with the inner guide. The bearing assembly 6 further includes a pipe seal 76. The pipe seal 76 surrounds pipe (not shown) inserted through the bearing assembly to seal drill fluids and other fluids passing through the RCD 2 into a well bore. The pipe seal 76 can be coupled with the inner guide 10 using a bearing seal retainer 74, described in more detail below. FIG. 3 also illustrates the self-contained hydraulic reservoir 14 with the cover plate 16 removed. Passageways forming flow paths in the spool fluidically couple the hydraulic reservoir 14 with the latching assembly cylinder bores 30.

Figure 4:
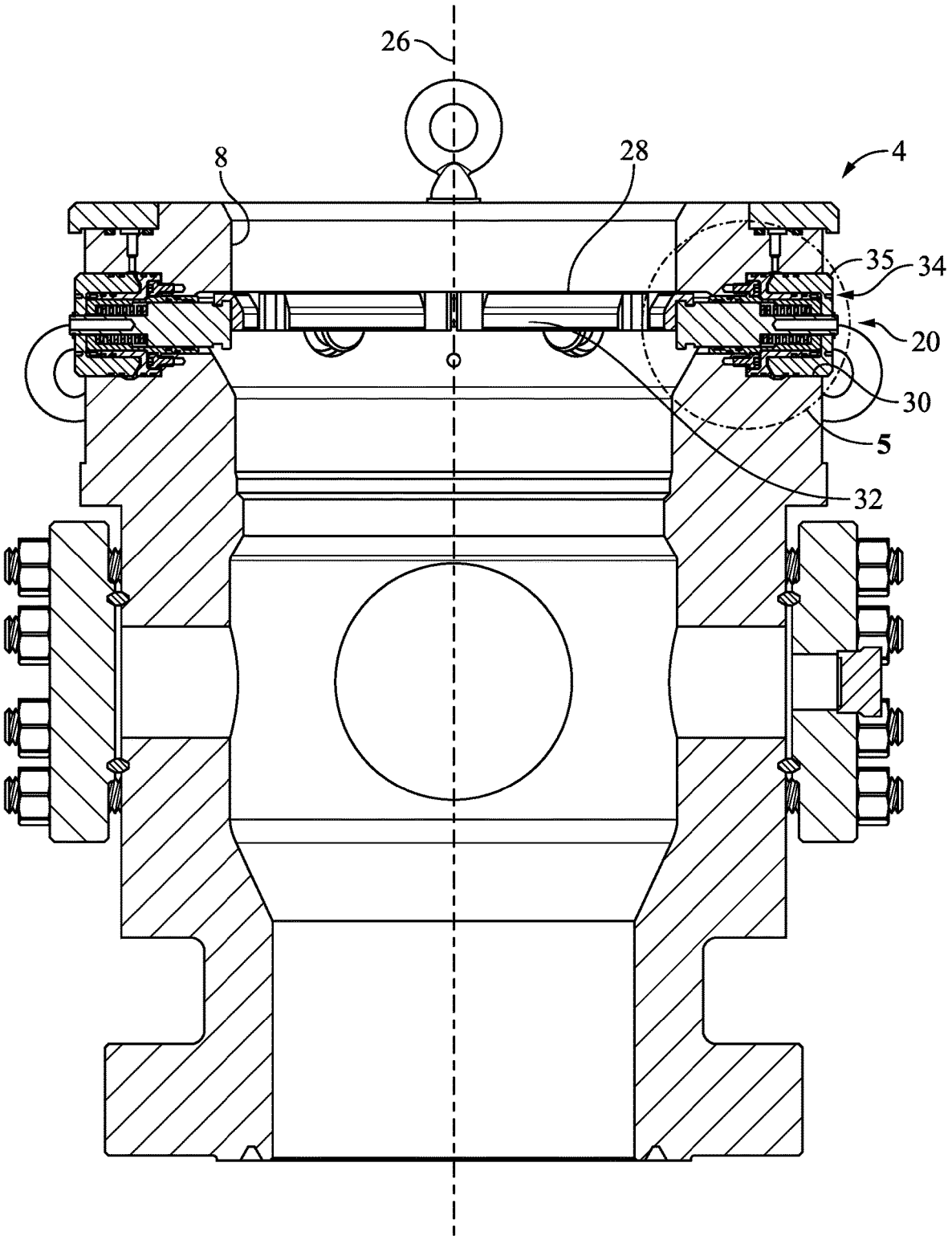
FIG. 4 is a schematic cross sectional view of the RCD of FIG. 1 in an unpressurized state as being normally closed with spring-biased pistons extended toward a spool bore and coupled with latching elements for the bearing assembly.
Figure 5:
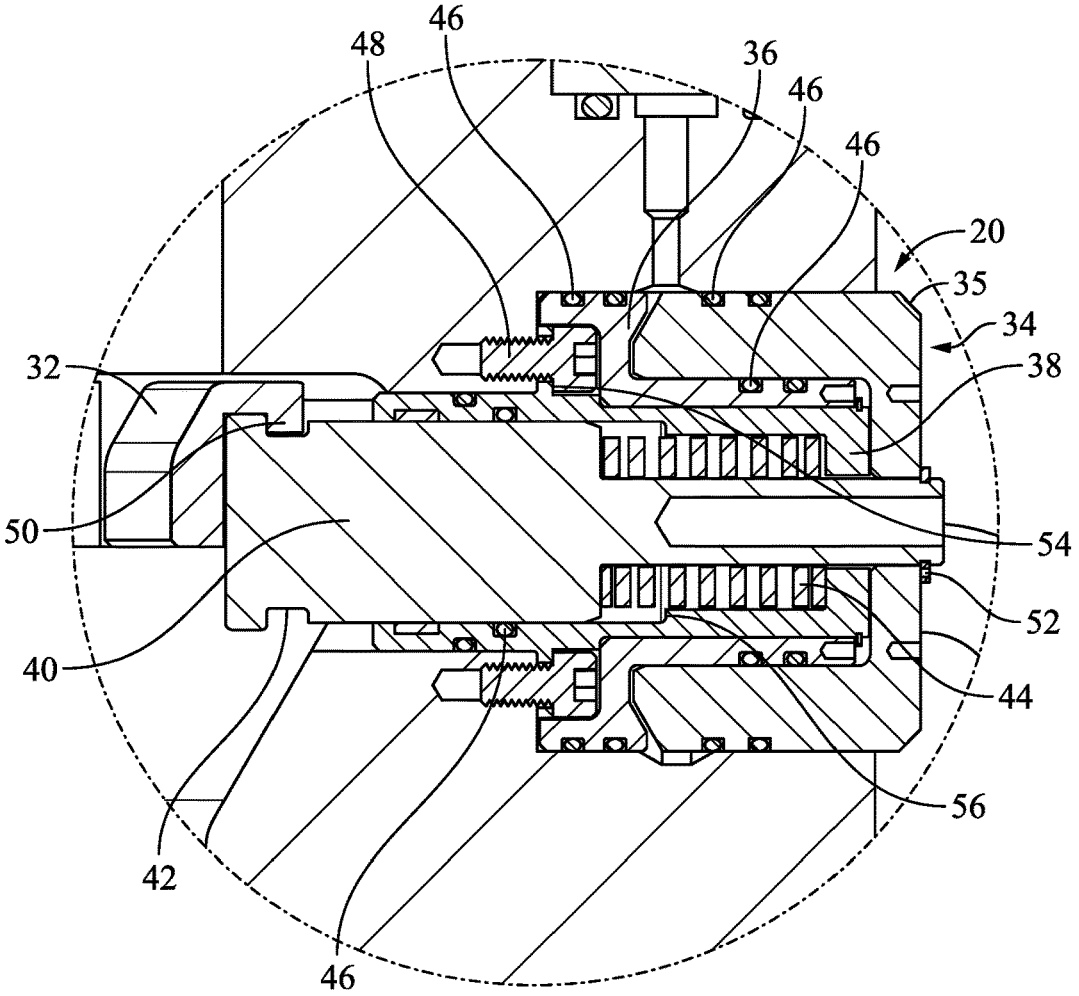
FIG. 5 is a schematic cross sectional view of a latching assembly shown in FIG. 4 having a piston with a piston rod coupled with a latching element.
Figure 6:
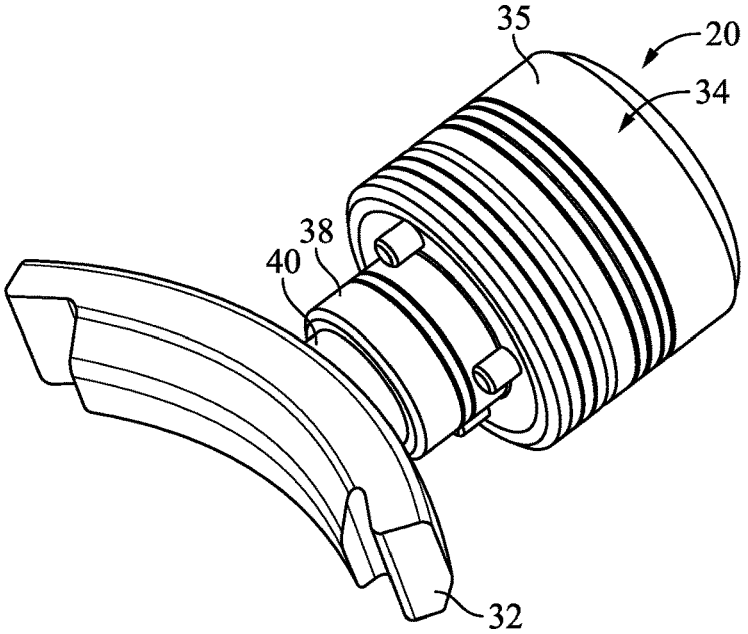
FIG. 6 is a schematic perspective view of the latching assembly of FIG. 5.

FIG. 4 is a schematic cross sectional view of the RCD of FIG. 1 in an unpressurized state as being normally closed with spring-biased pistons extended toward a spool bore and coupled with latching elements for the bearing assembly. FIG. 5 is a schematic cross sectional view of a latching assembly shown in FIG. 4 having a piston with a piston rod coupled with a latching element. FIG. 6 is a schematic perspective view of the latching assembly of FIG. 5. The spool 4 is generally formed with a plurality of latching assembly cylinder bores 30 around the spool periphery. A plurality of latching assemblies 20 can be coupled to the spool in the latching assembly cylinder bores 30 with fasteners 48 or other appropriate coupling devices. The latching assembly 20 can include a latching element 32 and a piston assembly 34. The latching element 32 can be recessed in a groove 28 formed in the spool bore for bore clearance during insertion of the bearing assembly 6 shown in FIG. 3.

The piston assembly 34 can include a piston 35, sealing ring 36, a piston rod housing 38 in which a piston rod 40 is coupled, and a bias element 44. The piston rod housing 38 can be mounted to the spool with fasteners 48. The sealing ring 36 can be slidably engaged on an outside peripheral surface of the piston rod housing 38. The piston 35 can be slidably engaged on an outside peripheral surface of the sealing ring 36 to slide radially inward and outward. Seals 46 can be positioned around various sealing surfaces. The piston rod 40 can extend through a distal end, relative to the spool bore 8, of the piston rod housing 38 and through the piston 35. The piston rod can be coupled to a distal surface on the end of the piston 35 with a retainer 52. A bias element 44, such as a compression spring, can be positioned in an annular space between the piston rod 40 and a surrounding peripheral inner wall of the piston rod housing 38. In as least one embodiment, the bias element 44 biases the piston rod to extend radially inward toward a center of the spool bore 8 (that is, toward the longitudinal axis 26) when not actuated by hydraulic pressure. Sufficient hydraulic pressure in the latching assembly cylinder bore 30 pulls the piston rod 40 radially outward away from the center of the spool bore 8 (that is, away from the longitudinal axis 26). The piston rod housing 38 is limited in radial movement by being fastened to the spool by the fasteners 48. The piston rod 40 is limited in outward radial movement from the spool bore 8 by a shoulder 56 formed between the piston rod housing 38 and the piston rod 40. The piston 35 is limited in inward radial movement toward the spool bore 8 by abutting the sealing ring 36. The piston rod 40 is limited in inward radial movement toward the spool bore 8 by the retainer 52 coupled with the piston 35, when the piston 35 abuts the sealing ring 36. The piston rod can include a piston rod latch surface 42 configured to couple with a corresponding latching element latch surface 50 of the latch element 32.

As mentioned above, the state of the piston in FIG. 4 is an unpressurized state as being normally closed with spring-biased pistons extended toward a spool bore and coupled with latching elements for the bearing assembly. An external indication that is visible to field crew is the location of the latching assembly 20, specifically the piston 35 of the piston assembly 34, relative to an outer surface of the spool 8. In FIG. 4, an illustrative position of the piston assembly 34 is a small protrusion external to the spool outer surface.

Figure 7:
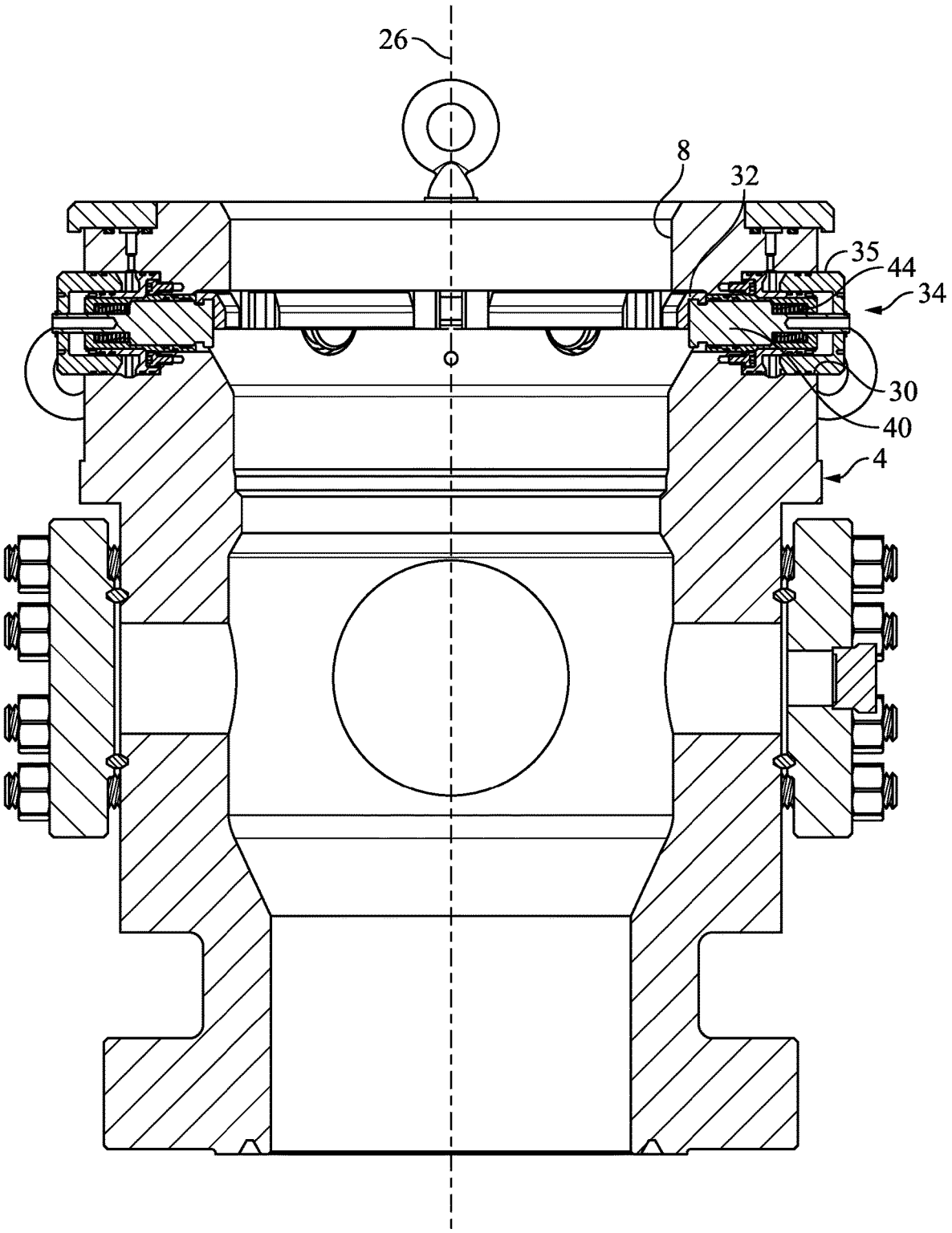
FIG. 7 is a schematic cross sectional view of the RCD of FIG. 4 in a pressurized state as being open with spring-biased pistons retracted away from the spool bore.

FIG. 7 is a schematic cross sectional view of the RCD of FIG. 4 in a pressurized state as being open with spring-biased pistons retracted away from the spool bore. Fluid pressure from the self-contained hydraulic reservoir 14 described herein pushes the piston 40 radially outward, and consequently the piston rod 40 retracts the latching element 32 away from the center of the spool bore 8 against the force of the bias element 44. The piston assembly 34 protrudes radially outward further from the surface of the spool 8 compared to the piston assembly position shown in FIG. 4. Advantageously, the latching element 32 can be pulled into the groove 28 for bore clearance.

Figure 8:
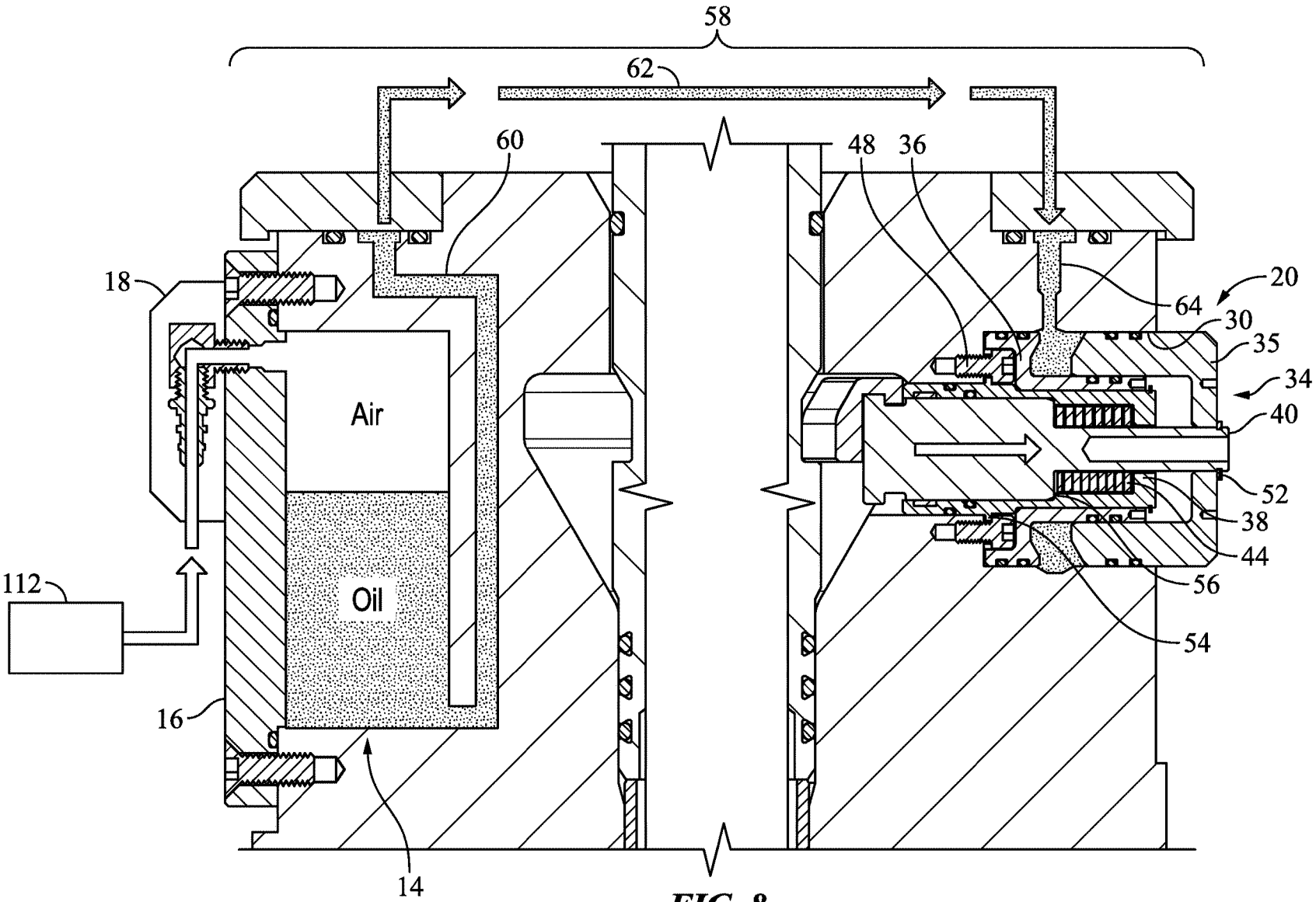
FIG. 8 is a schematic hydraulic fluid flow diagram showing a schematic flow path from a self-contained hydraulic reservoir on the spool to the latching assembly piston in the latching assembly cylinder bore.

FIG. 8 is a schematic hydraulic fluid flow diagram showing a schematic flow path from a self-contained hydraulic reservoir on the spool to the latching assembly piston in the latching assembly cylinder bore. The self-contained hydraulic reservoir 14 in the spool 4 is sealed with cover plate 16 that provides an opening into the reservoir as needed and provides a location for a pressure port 18. The pressure port 18 allows pressurized fluid, such as air or other gases, and can include even liquids, from a pressure source 112 to enter the reservoir and pressurize fluid, such as hydraulic fluid, in the reservoir to actuate the latching assemblies 20. A flow path 60 from the reservoir 14 can provide fluid to a spool flow path 62. The spool flow path 62 can be formed in or under a removable portion of the spool 4 and can form a circular channel around the spool to interconnect with a plurality of latch assembly flow paths 64 for each of the latching assembly cylinder bores 30. The flow path 60, spool flow path 6, and latch assembly flow path 64 form a fluid flow path 58 from the self-contained hydraulic reservoir 14 to the latching assembly cylinder bores 30.

The self-contained hydraulic reservoir 14, fluid flow path 58, and latching assembly cylinder bore 30 in cooperation with the latching assembly 20 with sufficient volume of hydraulic fluid to actuate pistons in latching assembly cylinder bores circumferentially located around the spool. With the hydraulic system path being closed, minimal hydraulic fluid and a minimally sized reservoir 14 is needed. The hydraulic reservoir 14 can be self-contained on the RCD 2 to eliminate the HPU typically on the rig floor.

Figure 9:
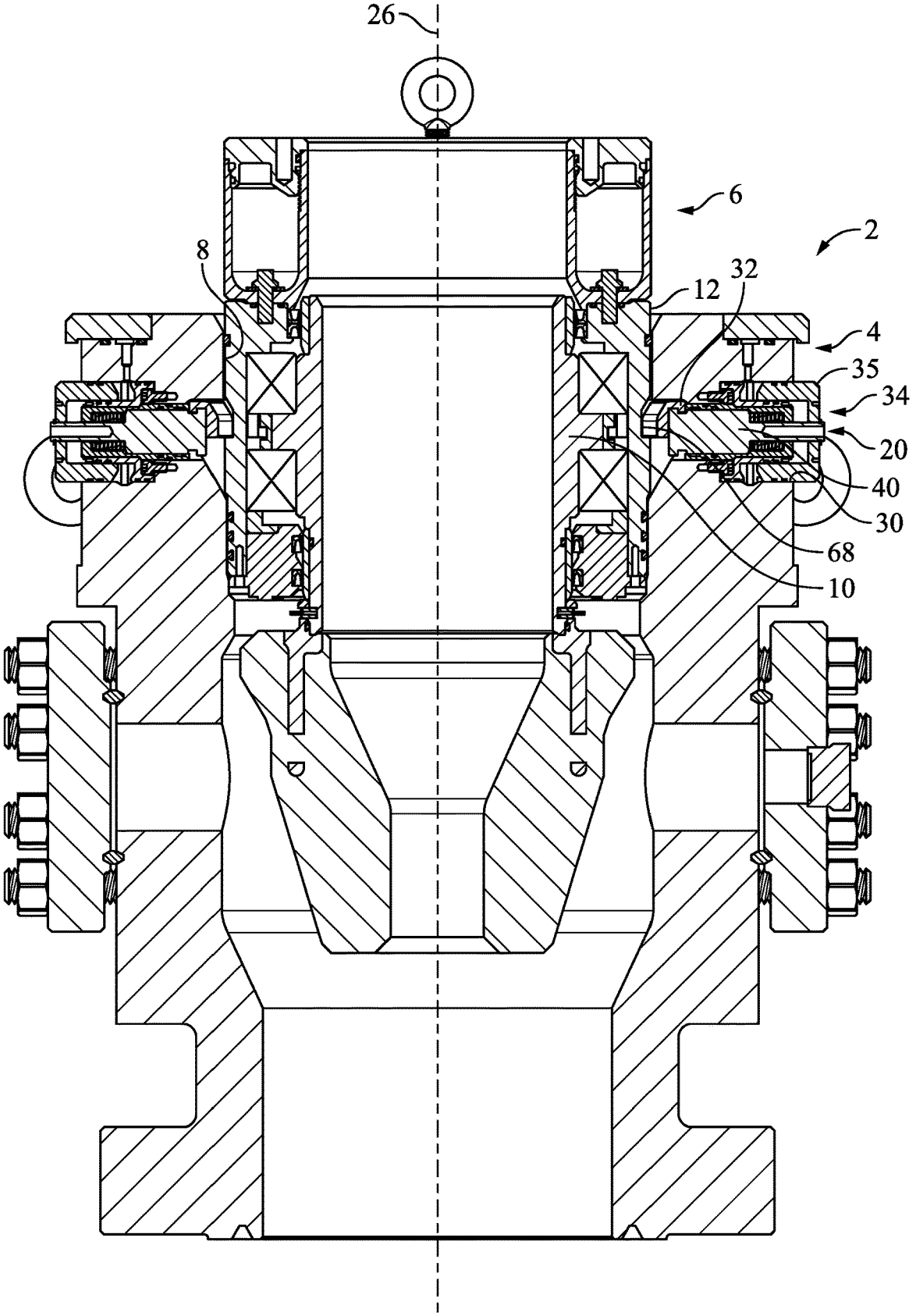
FIG. 9 is a schematic cross sectional view of the RCD of FIG. 7 in a pressurized state as being open with spring-biased pistons retracted away from the spool bore and the bearing assembly inserted into the spool.

FIG. 9 is a schematic cross sectional view of the RCD of FIG. 7 in a pressurized state as being open with spring-biased pistons retracted away from the spool bore and the bearing assembly inserted into the spool. With the pistons 40 retracted with the latching elements 32, the spool bore 8 is ready to receive the bearing assembly 6. Pressurized fluid in the latching assembly cylinder bores 30 maintains the retracted positions of the piston rods 40 and latching elements 32. The bearing assembly 6 can be inserted into the spool bore 8 and land on a shoulder in a lower portion of the spool bore 8. A bearing assembly latch surface 68 can longitudinally align with a retracted latching element 32.

Figure 10:
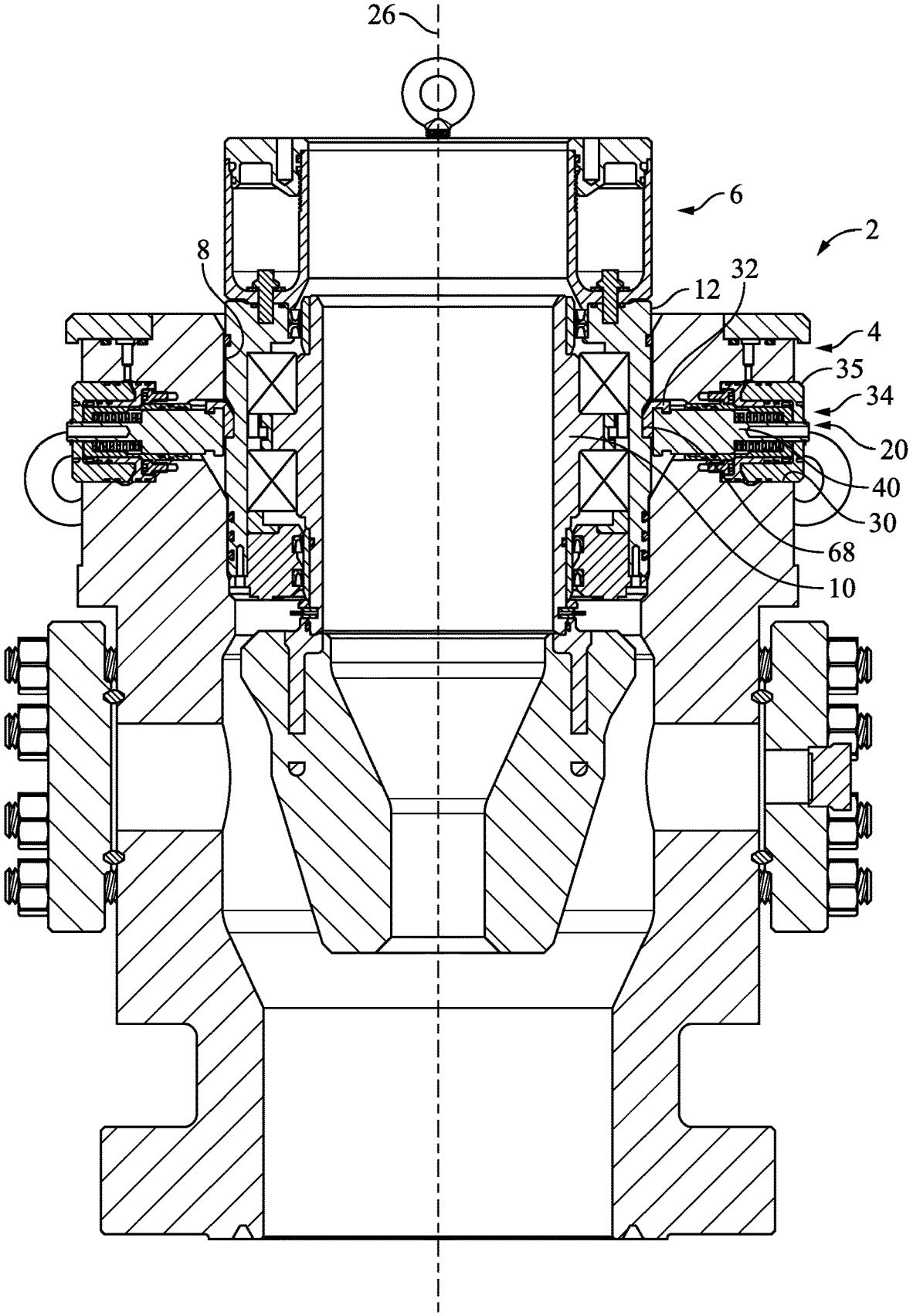
FIG. 10 is a schematic cross sectional view of the RCD of FIG. 9 with the latching assembly being depressurized to allow the latching elements to move radially inward to secure the bearing assembly in the spool.

FIG. 10 is a schematic cross sectional view of the RCD of FIG. 9 with the latching assembly being depressurized to allow the latching elements to move radially inward to secure the bearing assembly in the spool. With the bearing assembly 6 in longitudinal position in the spool bore 8, the pressure in the port 18 described above can be at least reduced or released and the hydraulic fluid is no longer activating the piston assemblies 34 in a retracted position. The term "depressurized" is used broadly to be a pressure, if any, of the fluid that results in a lower force relative to the bias force of the bias element 44 in the piston assembly, so that the piston rod 40 can move due to the greater bias force. Without sufficient hydraulic fluid pressure, the bias elements 44 are able to extend the piston rods 40 with latching elements 32 radially inwardly toward the bearing assembly and push a portion of the hydraulic fluid back into the reservoir. One or more of the latching elements 32 will be in proximity to the bearing assembly latch surface 68. Later, when the system begins operation and the rotating pipe in the bearing assembly causes the bearing assembly to rotate, the outer shell 12 can rotate temporarily until at least one of the latching elements 32 can engage the bearing assembly latch surface 68 and hold the outer shell 12 from further rotation while allowing the inner guide 10 can continue rotating with the pipe.

Figure 11A:
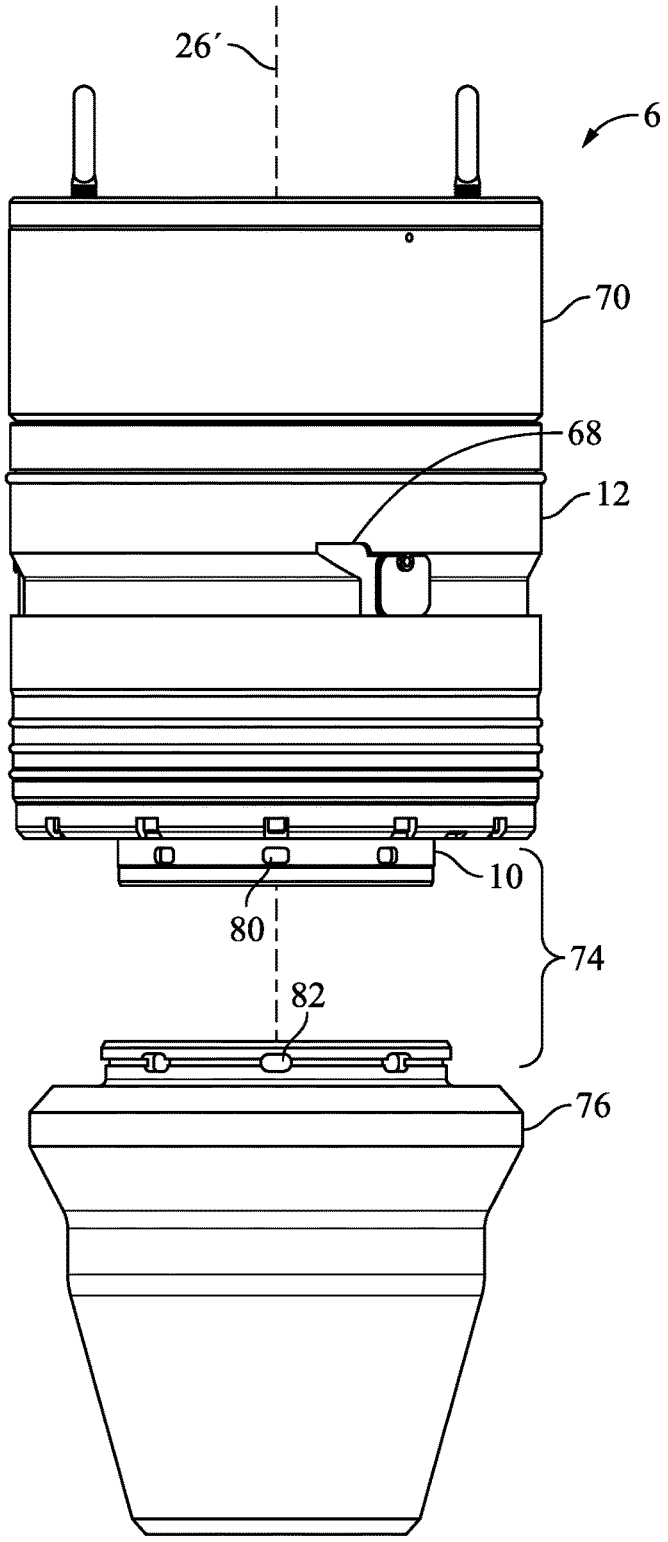
FIG. 11A is a schematic partial assembly view of a bearing assembly with a pipe seal and a components of an embodiment of a bearing seal retainer.
Figure 11B:
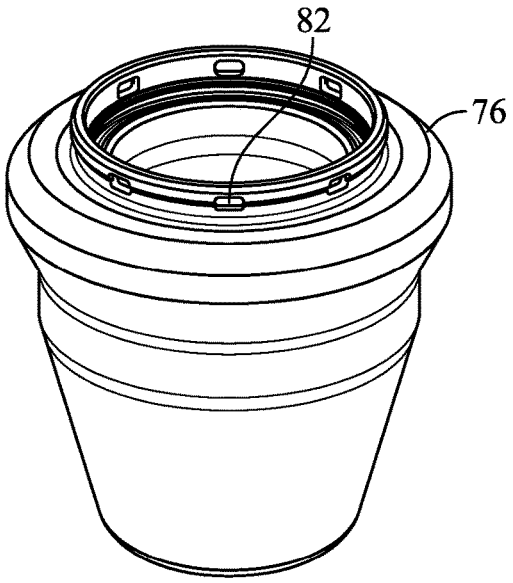
FIG. 11B is a schematic perspective view of the pipe seal shown in FIG. 11A.

FIG. 11A is a schematic partial assembly view of a bearing assembly with a pipe seal and a components of an embodiment of a bearing seal retainer. FIG. 11B is a schematic perspective view of the pipe seal shown in FIG. 11A. The bearing assembly 6 includes the outer shell 12 and the inner guide 10 that can rotate relative to the outer shell 12 using bearings inside the outer shell. In at least one embodiment, the bearing assembly 6 can include a self-contained lubricant reservoir 70, which is generally independent of a flow path from the self-contained hydraulic reservoir 14. The self-contained lubricant reservoir 70 can be coupled at a higher elevation than bearings in the outer shell 12 and be allowed to gravity flow lubricant into the bearings. Alternative, the self-contained lubricant reservoir 70 can be mounted at lower elevations and be pressurized with a pressure source, such as the pressure source 112 described above, to pressure the lubricant into the bearings.

The bearing assembly 6 can generally include the pipe seal 76 for sealing around pipe (not shown) that is inserted through the bearing assembly. The pipe seal 76 is generally coupled with the inner guide 10 and can rotate with the inner guide and pipe therein. The pipe seal 76 can be coupled to the inner guide 10 in various ways. An example of an embodiment is shown in FIGS. 11A and 11B. An end of the inner guide 10, such as a lower end, can be formed with inner guide slots 80. Advantageously, the slots can be "blind" slots that are formed only partially into the wall of the inner guide and not through the whole wall for at least a cross sectional size of the slot 80 that fits an insert 92, shown in FIG. 13. The blind slot allows pressing in the insert 92 without the insert falling through the slot 80. Pipe seal slots 82 are formed in the pipe seal 76 to align with the inner guide slots 80 when the pipe seal is being coupled with the inner guide 10.

Figure 12:
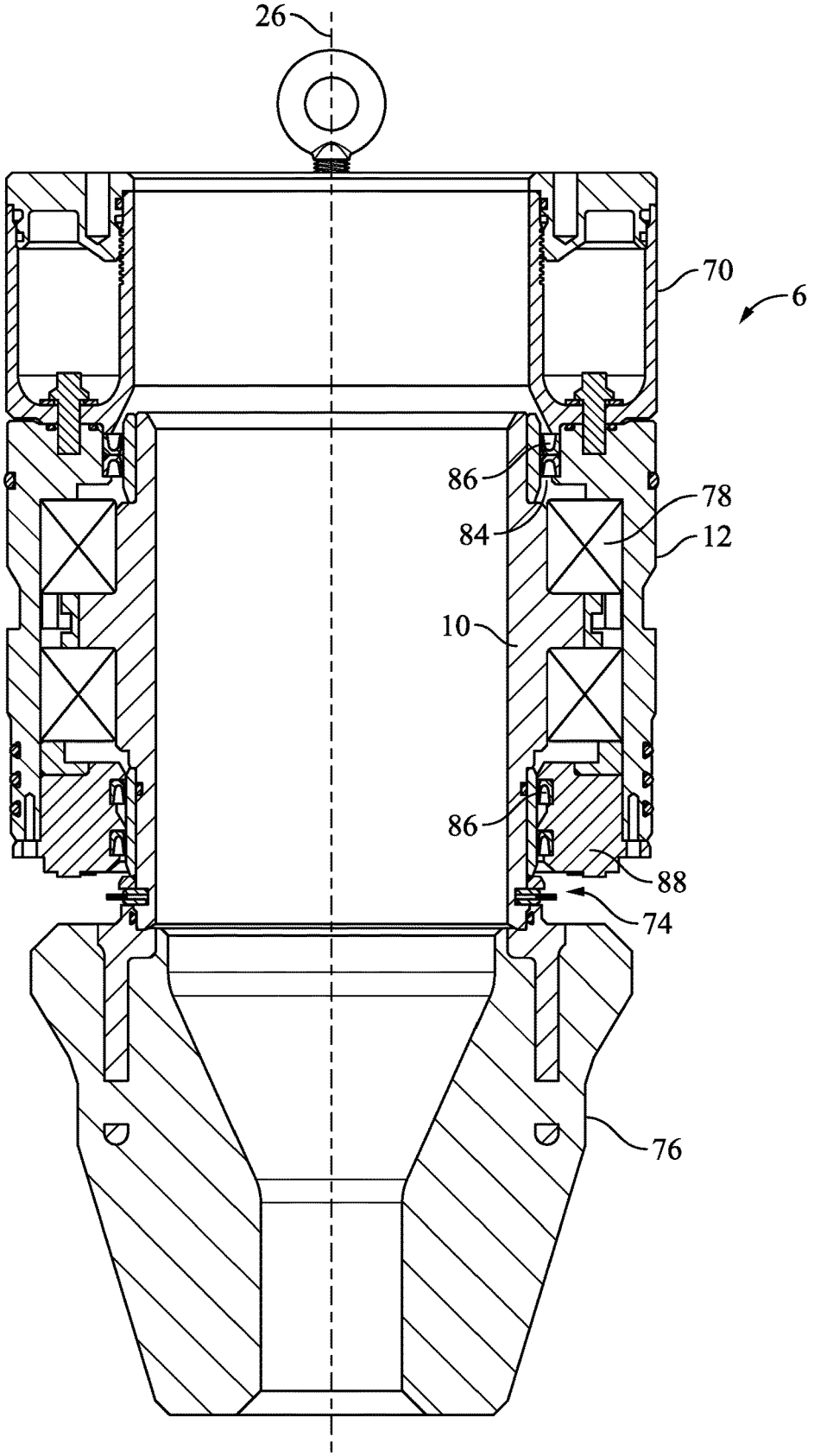
FIG. 12 is an enlarged schematic cross sectional view of the bearing assembly of FIG. 9.

FIG. 12 is an enlarged schematic cross sectional view of the bearing assembly of FIG. 9. As described above, the bearing assembly 6 includes the outer shell 12 with one or more bearings 78 positioned between an inner wall of the outer shell 12 and an outer wall of the inner guide 10. In at least one embodiment, the self-contained lubricant reservoir 70 with a supply of lubricant can gravity flow the lubricant through a lubricant outlet 84 onto surfaces of the bearings 78. The lubricant can continue through the bearings 78 into a lower holding tank 88. Seals 86 at various positions can help retain the lubricant in the outer shell 12 and bearings 78.

The inner guide 10 is shown coupled to the pipe seal 76 with the bearing seal retainer 74. Other details and embodiments of the coupling between the inner guide and pipe seal are described below.

Figure 13:
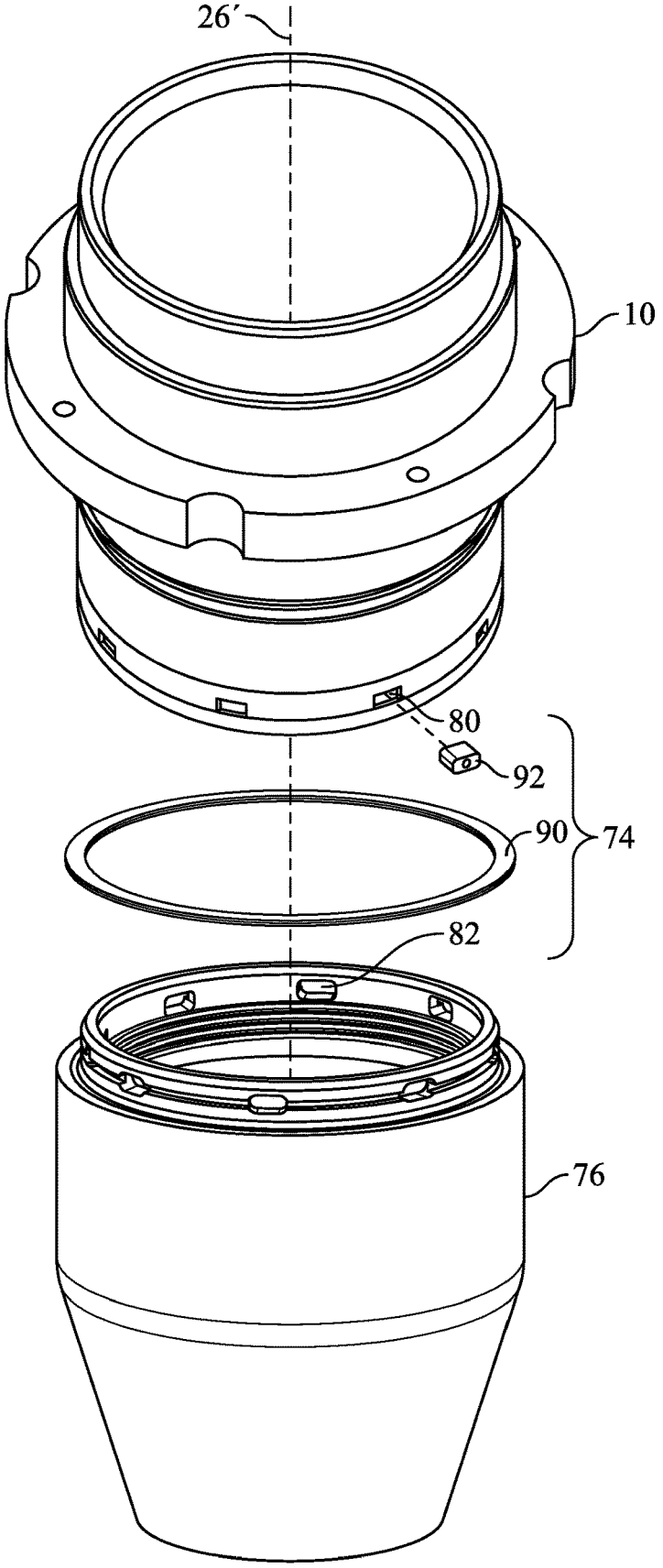
FIG. 13 is a schematic partial assembly view of an inner guide of the bearing assembly positioned to engage with the pipe seal using a retainer with an insert.

FIG. 13 is a schematic partial assembly view of an inner guide of the bearing assembly positioned to engage with the pipe seal using a retainer with an insert. This embodiment of the bearing seal retainer can include slots in the inner guide 10 and pipe seal 76, seal lock ring 90, and inserts 92. The inner ring 10 includes the inner guide slots 80 configured to receive the inserts 92. Advantageously, the slots 80 are formed partially therethrough to allow the inserts 92 to be inserted from an exterior position of the assembly and not fall through to an internal portion to the inner guide 10. The pipe seal 76 has corresponding pipe seal slots 82 formed therethrough. In the embodiment shown, the pipe seal 76 is sized to fit over the outside diameter of the inner guide 10 and the inserts 92 can be placed through the pipe seal slots 82 into the inner guide slots 80. The seal lock ring 90 is sized to be placed circumferentially over the inserts 92 once placed in the slots to retain the inserts in the slots. It is understood that a variation of this embodiment is that the pipe seal 76 could be sized to be inserted inside the inner guide 10, such as in a circumferential recess, and the pipe seal slots 82 could instead be formed as the partially blind slots and the inner guide slots formed through the inner guide instead.

Figure 14:
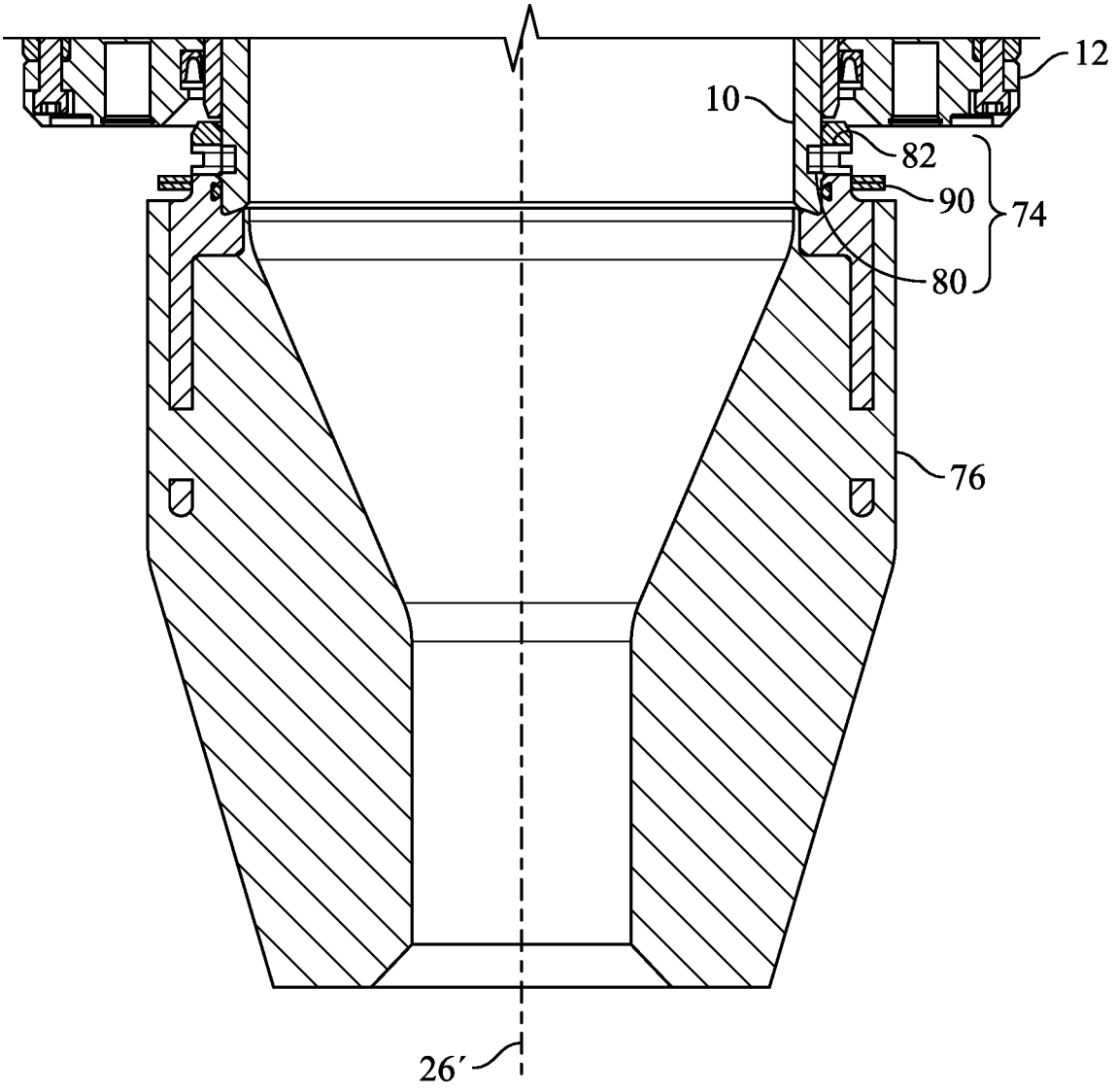
FIG. 14 is a schematic partial cross sectional view of the pipe seal engaged with the inner guide and positioned to be coupled together.

FIGS. 14 through 17 show an example of an assembly sequence with the bearing seal retainer described in FIG. 13. FIG. 14 is a schematic partial cross sectional view of the pipe seal engaged with the inner guide and positioned to be coupled together. The pipe seal 76 and/or inner guide 10 have been rotated sufficiently to align circumferentially the inner guide slots 80 with the pipe seal slots 82. Optionally, the seal lock ring 90 is positioned on an adjacent surface before the pipe seal and inner guide are assembled together although a flexible seal lock ring can be installed around the circumference at a later stage. For example, the seal lock ring 90 is shown positioned on an outer surface of the pipe seal adjacent the slots. In that position, the seal lock ring 90 is longitudinally offset from the slots and ready to be moved into longitudinal alignment with the slot after the inserts are assembled into the aligned slots.

Figure 15:
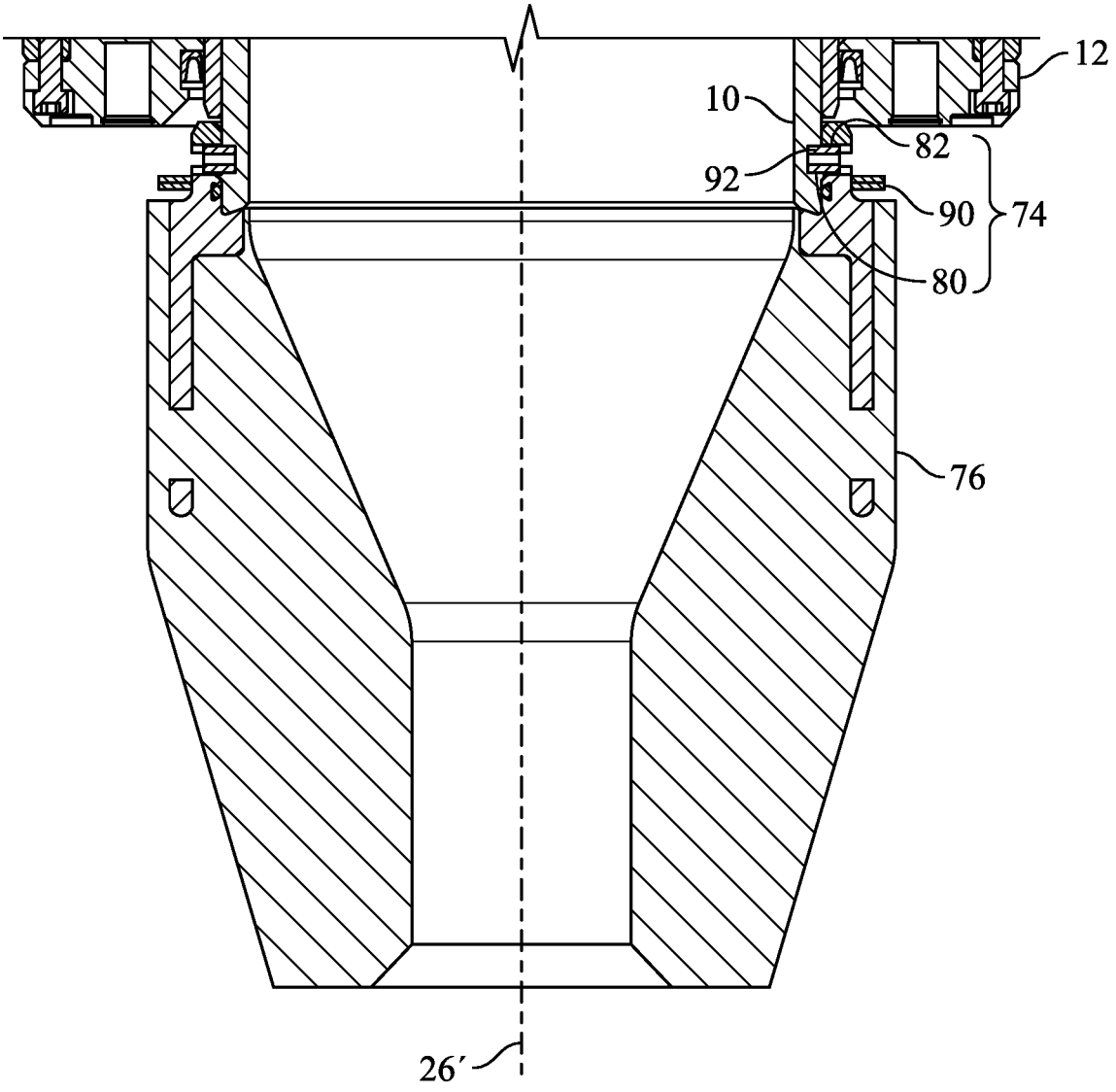
FIG. 15 is a schematic partial cross sectional view of the pipe seal engaged with the inner guide of FIG. 14 with inserts positioned in the pipe seal slots and the inner guide slots.

FIG. 15 is a schematic partial cross sectional view of the pipe seal engaged with the inner guide of FIG. 14 with inserts positioned in the pipe seal slots and the inner guide slots. The inserts 92 can be inserted into the aligned slots 80, 82 and are kept from falling into an internal portion of the inner guide 10 by the restricted partial depth of the inner guide slot 80 into the wall thickness of the inner guide.

Figure 16:
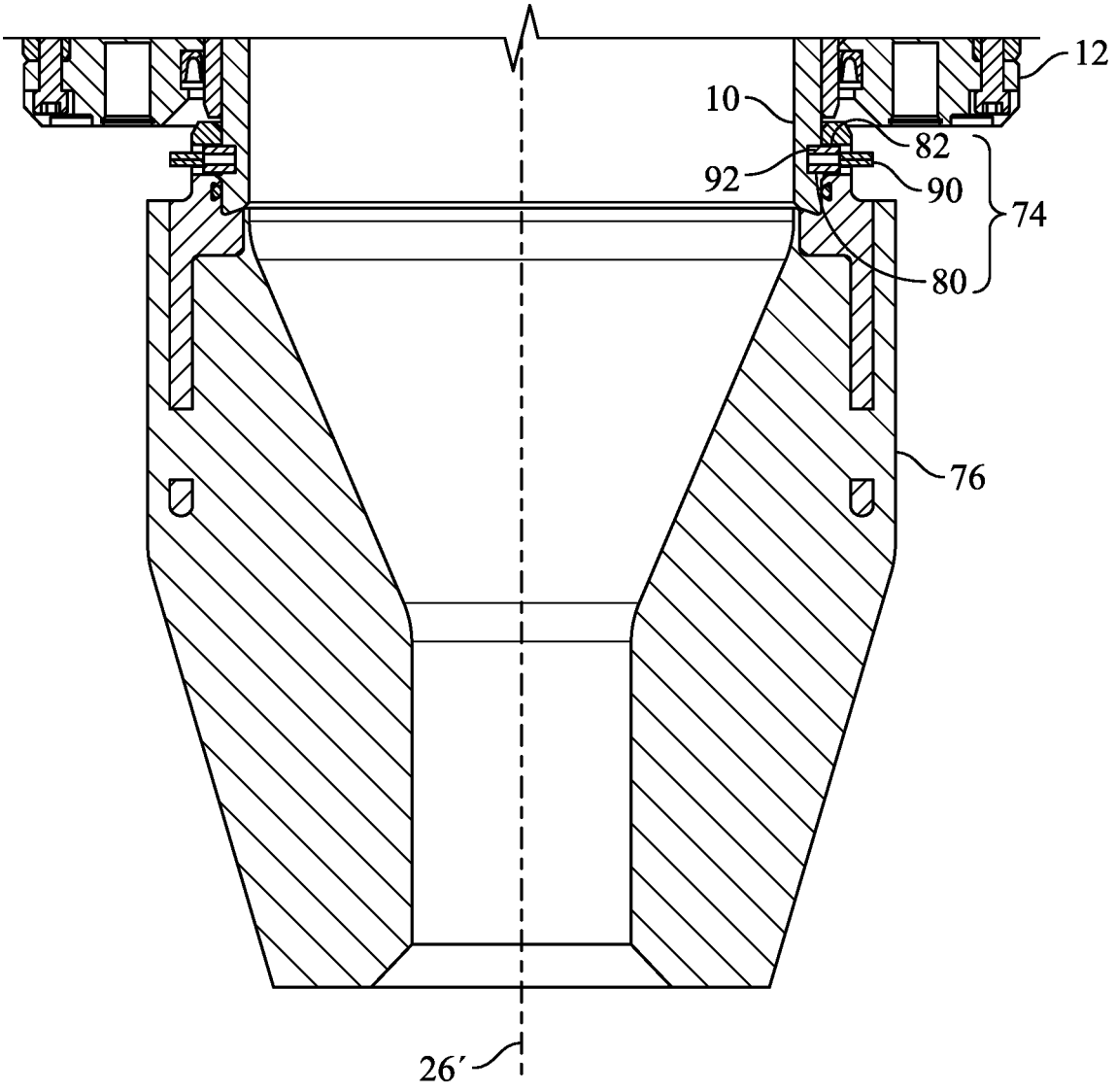
FIG. 16 is a schematic partial cross sectional view of the pipe seal coupled with the inner guide of FIG. 15 and the inserts and seal lock ring in position.

FIG. 16 is a schematic partial cross sectional view of the pipe seal coupled with the inner guide of FIG. 15 and the inserts and seal lock ring in position. With the inserts 92 positioned in the pipe seal slots 82 and the inner guide slots 80, the seal lock ring 90 can be moved into a longitudinal position aligned with the slots and radially outward of the inserts to restrain the inserts in the slots.

Figure 17:
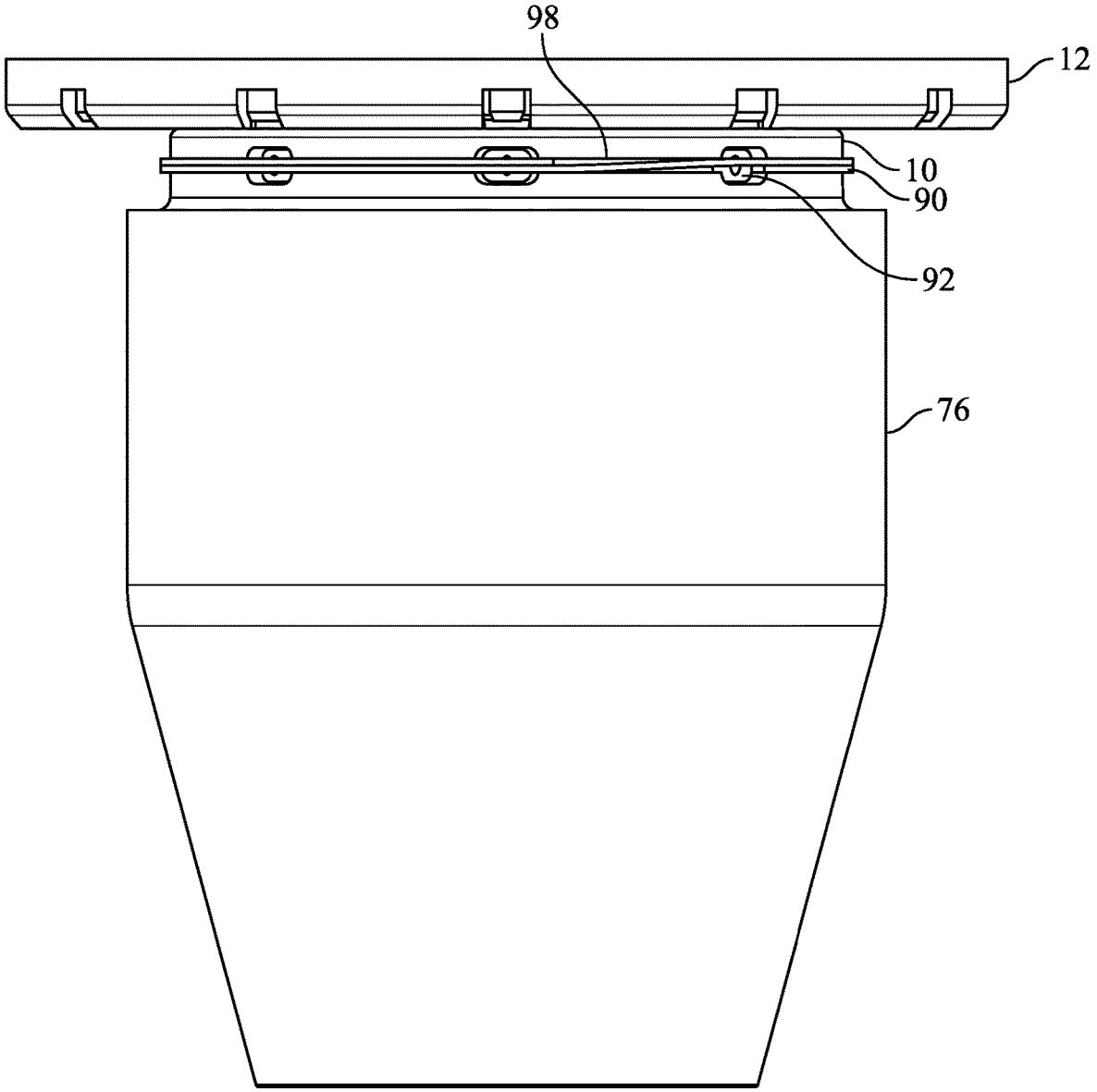
FIG. 17 is a schematic side view of the pipe seal coupled with the inner guide of FIG. 16, showing the inserts secured by the seal lock ring.

FIG. 17 is a schematic side view of the pipe seal coupled with the inner guide of FIG. 16, showing the inserts secured by the seal lock ring. The inserts 92 are held in the slots by the seal lock ring 90 to securely and easily couple the pipe seal 76 and inner guide 10, while the inner guide 10 is coupled with the outer shell 12. Optionally, a circumferential groove 98 can be formed around the pipe seal at the longitudinal position of the pipe seal slots, so that the seal lock ring can be restrained longitudinally from movement once placed over the inserts.

Figure 18:
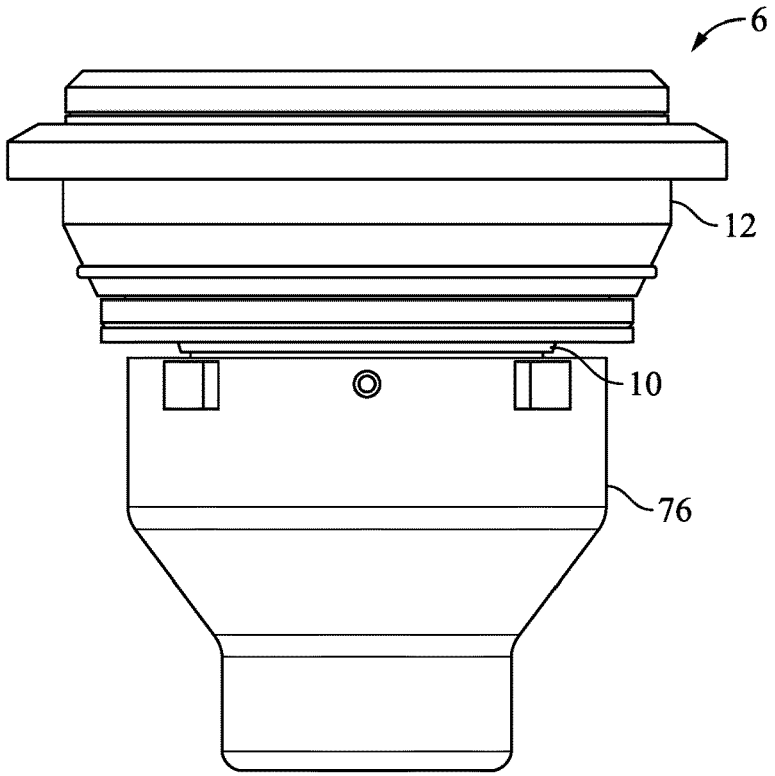
FIG. 18 is a schematic side view of another embodiment of a bearing seal retainer having threads for a seal engaged with an inner guide of the bearing assembly.
Figure 19:
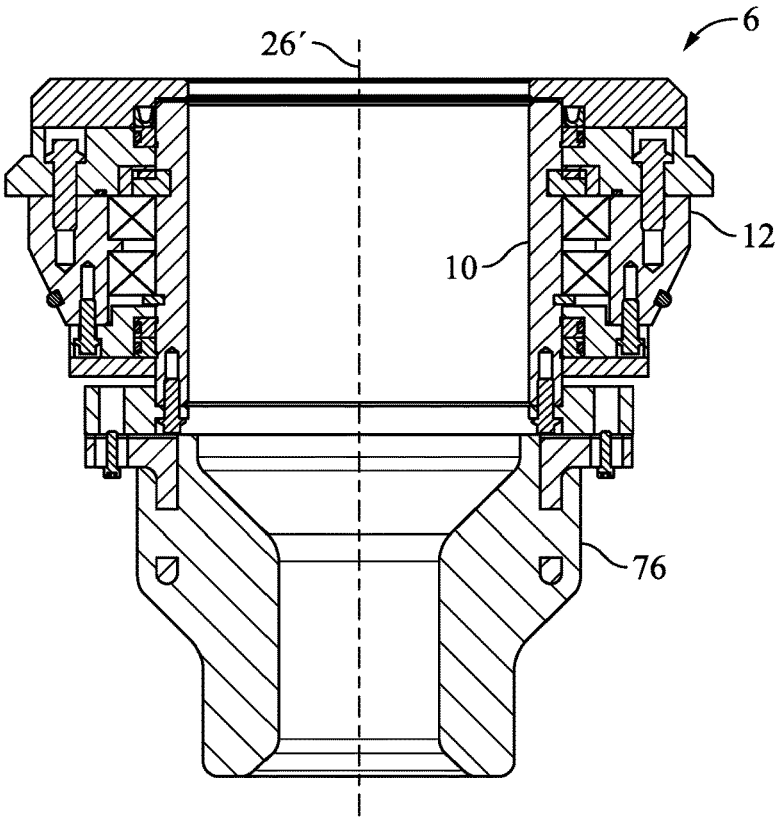
FIG. 19 is a schematic cross sectional view of the embodiment of FIG. 18.
Figure 20:
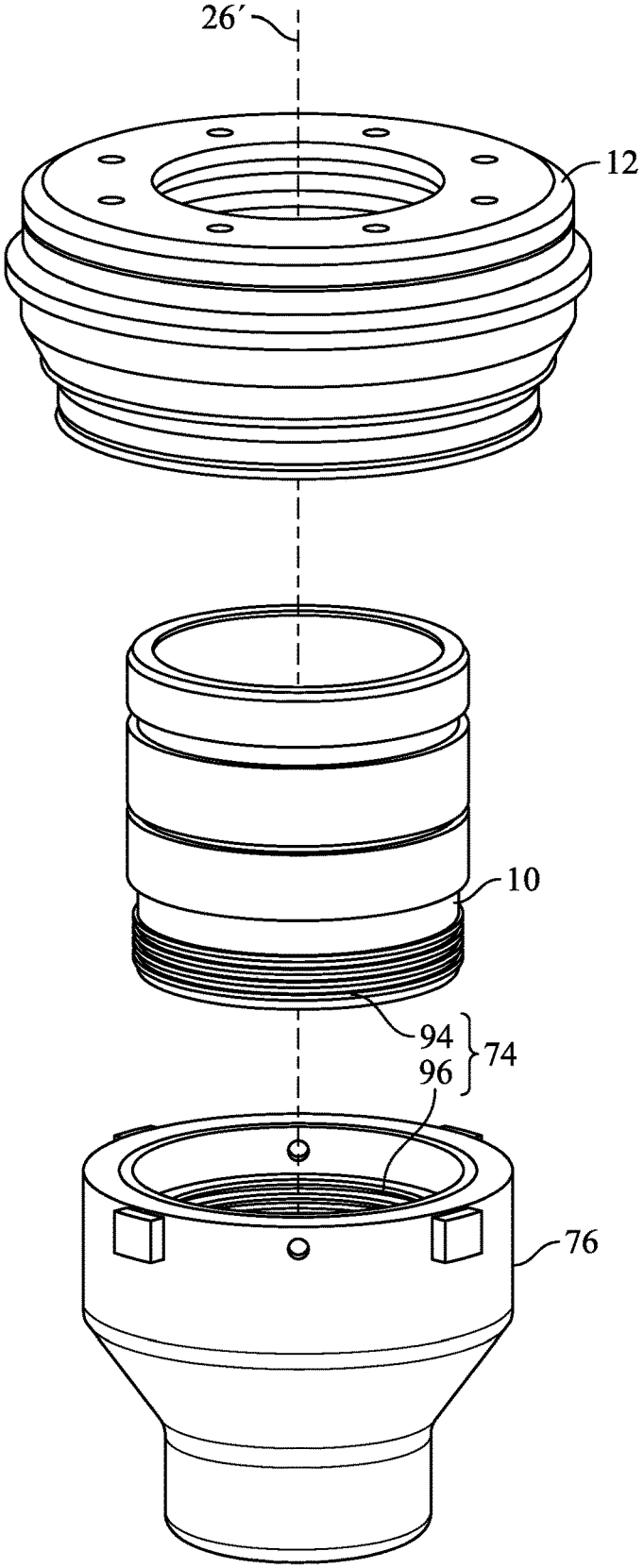
FIG. 20 is a schematic partial assembly view of the outer shell and guide of the bearing assembly positioned to be coupled with the seal with the embodiment of the bearing seal retainer in FIG. 18.

FIG. 18 is a schematic side view of another embodiment of a bearing seal retainer having threads for a seal engaged with an inner guide of the bearing assembly. FIG. 19 is a schematic cross sectional view of the embodiment of FIG. 18. FIG. 20 is a schematic partial assembly view of the outer shell and guide of the bearing assembly positioned to be coupled with the seal with the embodiment of the bearing seal retainer in FIG. 18. In this embodiment, the bearing seal retainer 74 includes threaded surfaces formed on the inner guide 10 and the pipe seal 76. An end of the inner guide 10 can be formed with external threads 94. The threads can be left-handed threads that tighten with customary counter clockwise rotation, that is, the opposite direction from the "right-hand rule". The pipe seal 76 can be formed with internal matching threads 96. The assembly can be readily assembled securely with minimal components and with less risk of dropping components down to the rig floor. A variation is to form internal threads on the inner guide and external threads on the pipe seal.

Figure 21:
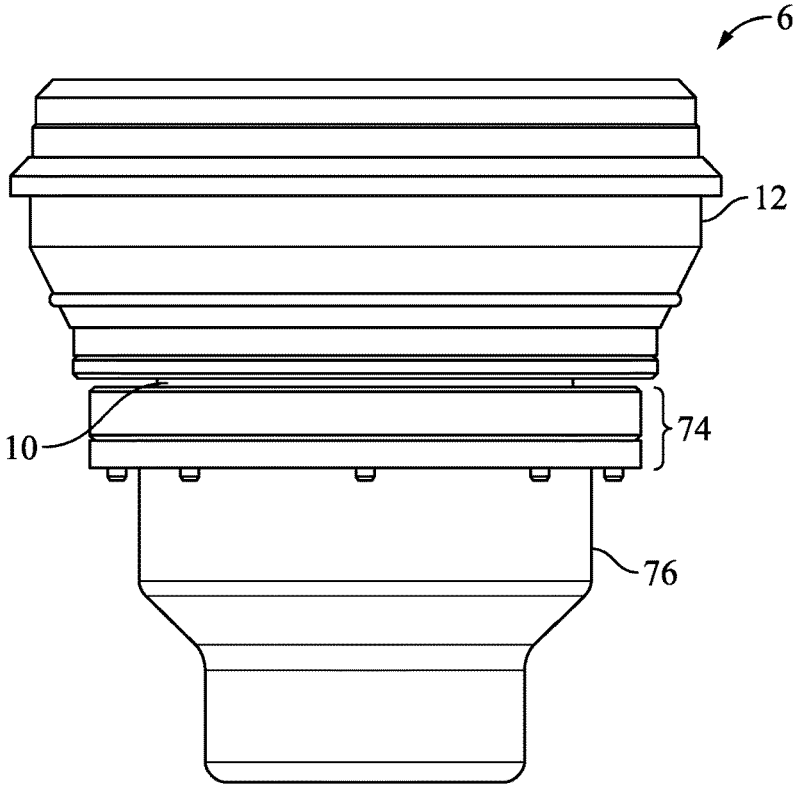
FIG. 21 is a schematic side view of another embodiment of a bearing seal retainer having flanges for a seal engaged with an inner guide of the bearing assembly.
Figure 22:
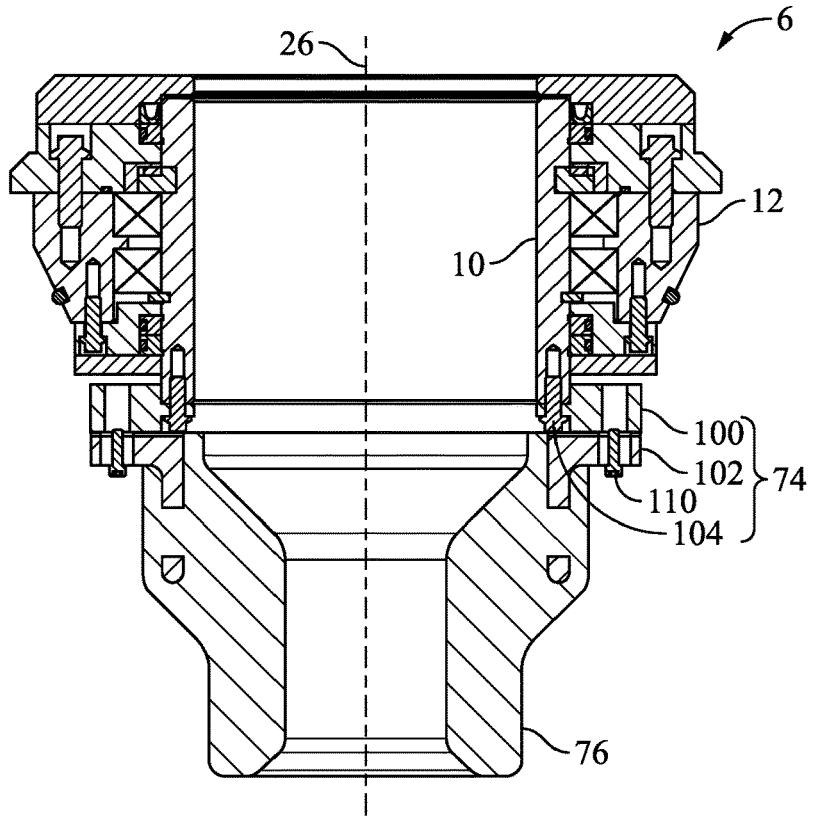
FIG. 22 is a schematic cross sectional view of the embodiment of FIG. 18.
Figure 23:
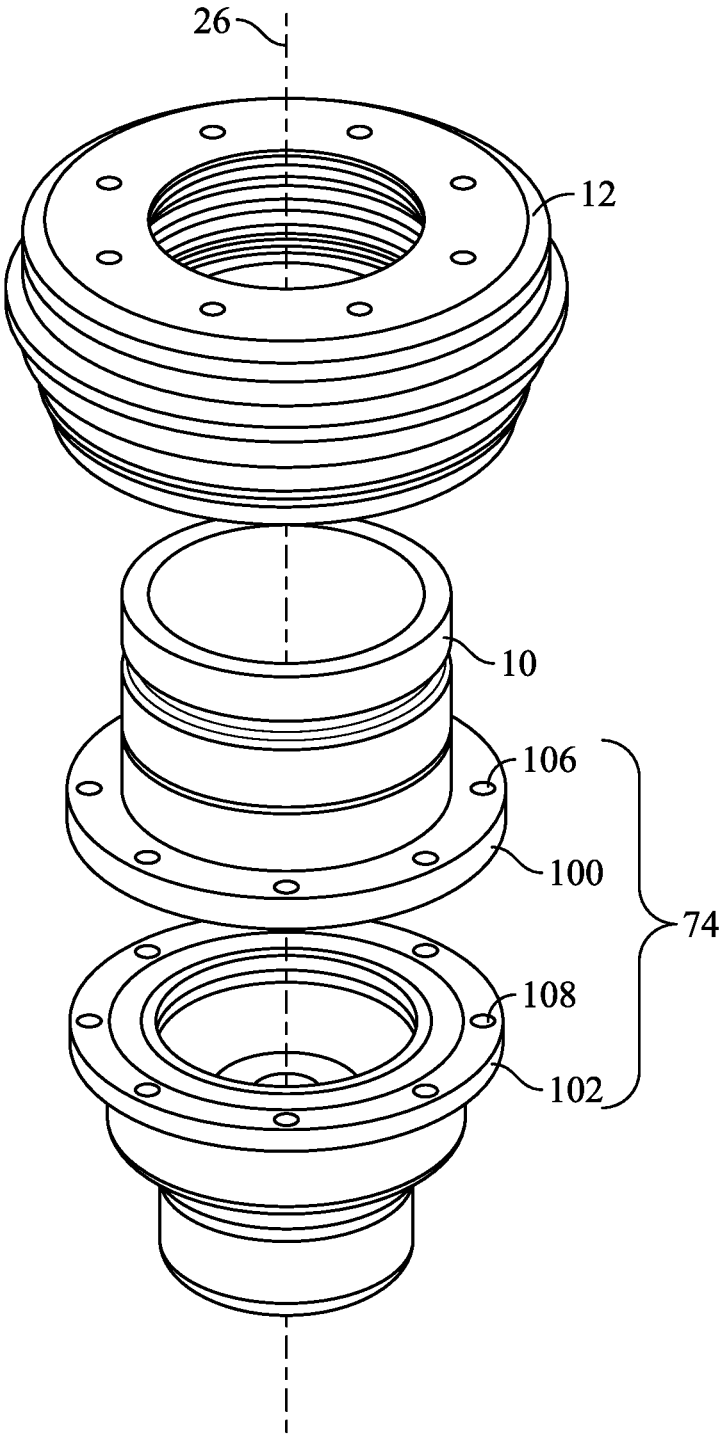
FIG. 23 is a schematic partial assembly view of the outer shell and guide of the bearing assembly positioned to be coupled with the seal with the embodiment of the bearing seal retainer in FIG. 21.

FIG. 21 is a schematic side view of another embodiment of a bearing seal retainer having flanges for a seal engaged with an inner guide of the bearing assembly. FIG. 22 is a schematic cross sectional view of the embodiment of FIG. 18. FIG. 23 is a schematic partial assembly view of the outer shell and guide of the bearing assembly positioned to be coupled with the seal with the embodiment of the bearing seal retainer in FIG. 21. In this embodiment, the bearing seal retainer 74 includes flange components and fasteners. The inner guide 10 can be fitted with an inner guide flange 100. The inner guide flange 100 can be coupled with the inner guide 10 with fasteners 104. A corresponding flange 102 can be coupled by attaching or forming with the pipe seal 76. Fasteners 110 can couple the flanges 100 and 102 using openings 106 and 108, respectively, and thereby couple the inner guide 10 and pipe seal 76.

Other and further embodiments utilizing one or more aspects of the inventions described above can be devised without departing from the disclosed invention as defined in the claims. For example, other embodiments can types of slots, inserts, and retainers can be used to couple the seal with the bearing assembly, and other variations than those specifically disclosed above within the scope of the claims.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope of the following claims.

What is claimed is:

1. A rotating control device for use in extraction of fluids from a wellbore, comprising:

a spool having a bore along a longitudinal axis, the spool comprising:

a reservoir for fluid, the reservoir having a pressure port configured to receive pressure for the reservoir;

a latching assembly cylinder bore formed in the spool at an angle to the longitudinal axis;

a flow path for the fluid between the reservoir and the latching assembly cylinder bore; and a latching assembly coupled in the latching assembly cylinder bore, the latching assembly comprising:

a piston assembly comprising:

a sealing ring;

a piston slidably coupled with the sealing ring;

a piston rod housing coupled with the sealing ring;

a piston rod slidably coupled in the piston rod housing; and a bias element coupled between the piston rod and the piston rod housing; and a latching element coupled to the piston rod; and a bearing assembly removably coupled with the spool bore and having a bearing assembly latch surface configured to engage with the latching element when the latching element is extended toward the bearing assembly by the piston rod.

2. The rotating control device of claim 1, wherein the bias element is configured to bias the piston rod radially inward toward a center portion of the bearing assembly and the reservoir is configured to be selectively pressurized to pull the piston rod radially outward.

3. The rotating control device of claim 2, wherein the sealing ring is fixedly coupled to the spool and the piston is configured to slide radially outward relative to the sealing ring when the latching assembly cylinder bore is pressurized with the fluid.

4. The rotating control device of claim 2, wherein the sealing ring and piston rod housing are fixedly coupled to the spool and the piston rod is coupled with the piston and wherein the piston with the piston rod is configured to slide radially outward relative to the sealing ring when the latching assembly cylinder bore is pressurized with the fluid.

5. The rotating control device of claim 1, wherein the reservoir of the rotating control device is independent of a hydraulic power unit.

6. The rotating control device of claim 1, wherein pressurized air through the pressure port forms an air over hydraulic pressurized hydraulic reservoir.

7. The rotating control device of claim 1, wherein the bearing assembly comprises an outer shell, an inner guide rotatable coupled with the outer shell and a bearing disposed between the outer shell and inner guide.

8. The rotating control device of claim 7, wherein the bearing assembly further comprises a lubricant reservoir configured to provide lubricant to the bearing in the bearing assembly by gravity feed.

9. The rotating control device of claim 7, wherein the bearing assembly further comprises a lubricant reservoir configured to provide lubricant to the bearing in the bearing assembly by pressurized feed.

10. The rotating control device of claim 7, wherein the bearing assembly further comprises a pipe seal coupled to the inner guide with a bearing seal retainer, the bearing seal retainer comprising:

a plurality of inner guide slots formed in a side wall of the inner guide and a plurality of corresponding pipe seal slots formed in a side wall of the pipe seal and configured to align with the inner guide slots when assembled with the inner guide, inserts configured to be inserted into the seal slots and inner guide slots when the slots are aligned; and a retainer aligned with the slots and configured to retain the inserts in the slots.

11. A rotating control device for use in extraction of fluids from a wellbore, comprising:

a spool having a bore along a longitudinal axis, the spool comprising:

a reservoir for fluid, the reservoir having a pressure port configured to receive pressure for the reservoir;

a latching assembly cylinder bore formed in the spool at an angle to the longitudinal axis;

a flow path for the fluid between the reservoir and the latching assembly cylinder bore; and a latching assembly coupled in the latching assembly cylinder bore, the latching assembly comprising:

a piston assembly comprising:

a piston slidably coupled in the latching assembly cylinder bore;

a piston rod slidably coupled in the piston; and a bias element coupled between the piston rod and the piston; and a latching element coupled to the piston rod.

12. The rotating control device of claim 11, wherein the piston assembly further comprises a sealing ring and the piston is slidably coupled with the sealing ring.

13. The rotating control device of claim 12, wherein the piston assembly further comprises a piston rod housing coupled with the sealing ring, the piston rod is slidably coupled in the piston rod housing, and the bias element is coupled between the piston rod and the piston rod housing.

14. The rotating control device of claim 12, further comprising a bearing assembly removably coupled to the spool bore and having a bearing assembly latch surface configured to engage with the latching element.

15. The rotating control device of claim 11, wherein the rotary control device further comprises a bearing assembly removably coupled to the spool bore, the bearing assembly having a latch surface configured to engage with the latching element when the latching element is extended toward the bearing assembly by the piston rod.

16. The rotating control device of claim 11, wherein the flow path for the fluid between the reservoir and the latching assembly comprises a circular channel around the spool connecting a plurality of the latching assembly cylinder bores.

17. A method of configuring a rotating control device in extraction of fluids from a wellbore, the rotating control device having a spool having a bore along a longitudinal axis, the spool having a reservoir for fluid, the reservoir having a pressure port, a latching assembly cylinder bore formed in the spool at an angle to the longitudinal axis, a flow path for the fluid between the reservoir and the latching assembly cylinder bore, a latching assembly coupled in the latching assembly cylinder bore, the latching assembly having a piston assembly with a piston slidably coupled in the latching assembly cylinder bore, a piston rod slidably coupled in the piston, and a bias element coupled between the piston rod, and the piston and the latching assembly further having a latching element coupled to the piston rod, and a bearing assembly removably coupled to the spool in the spool bore, the method comprising:

pressurizing the reservoir on the spool through the pressure port;

allowing pressurized fluid from the reservoir to flow along the flow path to the latching assembly cylinder bore;

retracting the piston in a radially outward direction from a center of the spool;

inserting the bearing assembly in the spool bore;

depressurizing the fluid in the latching assembly cylinder bore;

allowing the piston to extend radially inward; and allowing the latching element to engage the bearing assembly.

18. The method of claim 17, wherein the bearing assembly comprises an outer shell and an inner guide within the outer shell, the inner guide having inner guide slots formed in a wall of the inner guide, and a pipe seal having corresponding pipe seal slots formed in a wall of the pipe seal, the method further comprising:

attaching the pipe seal to the inner guide, comprising:

aligning the pipe seal slots with the inner guide slots;

placing inserts into the aligned slots of the pipe seal and inner guide; and retaining the inserts in the aligned slots with a seal lock ring.

19. The method of claim 17, wherein the spool further comprises a lubricant reservoir, the method further comprising providing lubricant from the lubricant reservoir into a bearing in the spool.

20. The method of claim 17, further comprising removing the bearing assembly from the spool bore, comprising:

pressurizing the reservoir on the spool through the pressure port;

allowing pressurized fluid from the reservoir to flow along the flow path to the latching assembly cylinder bore;

retracting the piston in a radially outward direction from a center of the spool;

removing the bearing assembly from the spool bore;

depressurizing the fluid in the latching assembly cylinder bore; and allowing the piston to extend radially inward.

* * * * *